US012084936B2

(12) United States Patent
Suazo et al.

(10) Patent No.: US 12,084,936 B2
(45) **Date of Patent: *Sep. 10, 2024**

(54) PRESSURE CONTROL ASSEMBLY

(71) Applicant: AXIS SERVICE, LLC, Perryopolis, PA (US)

(72) Inventors: Kathy Suazo, San Antonio, TX (US); Joseph Sites, Venetia, PA (US); Michael Russell, McMurray, PA (US)

(73) Assignee: AXIS SERVICE, LLC, Perryopolis, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/393,934

(22) Filed: Dec. 22, 2023

(65) Prior Publication Data

US 2024/0125191 A1 Apr. 18, 2024

Related U.S. Application Data

(63) Continuation of application No. 18/181,632, filed on Mar. 10, 2023, now Pat. No. 11,867,017.

(60) Provisional application No. 63/318,814, filed on Mar. 11, 2022.

(51) Int. Cl.
*E21B 33/02* (2006.01)
*E21B 19/00* (2006.01)

(52) U.S. Cl.
CPC ..... *E21B 33/02* (2013.01); *E21B 19/00* (2013.01)

(58) Field of Classification Search
CPC ..... E21B 33/02; E21B 19/00
See application file for complete search history.

(56) References Cited

U.S. PATENT DOCUMENTS

| | | | |
|---|---|---|---|
| 4,423,775 | A | 1/1984 | Wilson |
| 4,428,421 | A | 1/1984 | Rankin |
| 4,718,487 | A | 1/1988 | Lanmon, II |
| 4,886,115 | A | 12/1989 | Leggett et al. |
| 4,899,816 | A | 2/1990 | Mine |
| 4,938,290 | A | 7/1990 | Leggett et al. |
| 6,588,502 | B2 | 7/2003 | Nice |
| 7,207,381 | B2 | 4/2007 | Sharp |
| 7,510,002 | B2 | 3/2009 | Brown et al. |
| 8,640,795 | B2 | 2/2014 | Jekielek |
| 9,145,761 | B2 | 9/2015 | Hallundbæk et al. |
| 9,523,270 | B2 | 12/2016 | Fripp et al. |
| 9,879,520 | B2 | 1/2018 | Fanini et al. |
| 10,648,249 | B2 | 5/2020 | Varkey |
| 10,689,916 | B2 | 6/2020 | Varkey et al. |
| 10,738,535 | B2 | 8/2020 | Wern et al. |
| 10,767,438 | B2 | 9/2020 | Papadimitriou et al. |
| 10,961,839 | B2 | 3/2021 | Schlosser |
| 11,111,735 | B2 | 9/2021 | Massey et al. |
| 11,428,063 | B1 | 8/2022 | Strankman |

(Continued)

FOREIGN PATENT DOCUMENTS

| | | | |
|---|---|---|---|
| CN | 109577949 | A | 4/2019 |
| WO | 2021076844 | A1 | 4/2021 |

OTHER PUBLICATIONS

"Hydraulic Pack Off Pressure Control Equipment | Stand-Alone Products", Hunting, downloaded from http://www.hunting-intl.com/well-intervention-equipment/pressure-control-equipment.

*Primary Examiner* — Taras P Bemko
(74) *Attorney, Agent, or Firm* — Trop, Pruner & Hu, P.C.

(57) ABSTRACT

An embodiment includes a greaseless multi-level pressure control assembly.

16 Claims, 18 Drawing Sheets

(56) References Cited

U.S. PATENT DOCUMENTS

| | | | |
|---|---|---|---|
| 2002/0139535 | A1 | 10/2002 | Nice et al. |
| 2003/0098161 | A1 | 5/2003 | Boyd |
| 2004/0011519 | A1 | 1/2004 | Nice |
| 2010/0126717 | A1 | 5/2010 | Kuchuk et al. |
| 2011/0017444 | A1 | 1/2011 | McCollin |
| 2015/0000913 | A1 | 1/2015 | Lelong-Feneyrou et al. |
| 2019/0003278 | A1 | 1/2019 | Varkey et al. |
| 2019/0024499 | A1 | 1/2019 | DiFoggio |
| 2020/0347691 | A1 | 11/2020 | Craig et al. |
| 2021/0062589 | A1 | 3/2021 | Kennedy |
| 2021/0087898 | A1 | 3/2021 | Scott |
| 2021/0363859 | A1* | 11/2021 | Inglis ..... E21B 34/10 |

* cited by examiner

PRESSURE CONTROL ASSEMBLY

This application is a continuation of U.S. patent application Ser. No. 18/181,632, filed Mar. 10, 2023, which claims priority to U.S. Provisional Patent Application No. 63/318,814 filed Mar. 11, 2022 and entitled "Pressure Control Assembly". The content of each of the above applications is hereby incorporated by reference.

TECHNICAL FIELD

Embodiments of the invention are in the field of oil and gas activities (e.g., exploration and development) and, in particular, "pack off" or "packoff" assemblies.

BACKGROUND

In oil and gas field operations, equipment, tools, and explosives are commonly introduced into a high-pressure wellbore via an electrical and mechanical tether called a wireline. A wireline refers to a multi-conductor or single-conductor electric cable that is used for well intervention, well completions, and formation evaluation operations. The wireline is physically connected to the logging, mechanical, or explosive devices that are lowered into the wellbore. Inside the well, high pressure occurs naturally and can also be induced for certain operations known as hydraulic fracturing and pump down perforating. Regardless of its origin, pressures up to 15,000 psi are encountered on day-to-day activities and present a major hazard for all those present at the wellsite. One of the main concerns during operations is to maintain well integrity, which is achieved by implementing a series of barriers that are set in place throughout the completion process. These barriers are referred to as pressure control equipment. This specialized equipment allows well pressure to be safely isolated while having the ability to move the wireline and subsequently the wireline tools in and out of the well.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

DETAILED DESCRIPTION

Figure 1:
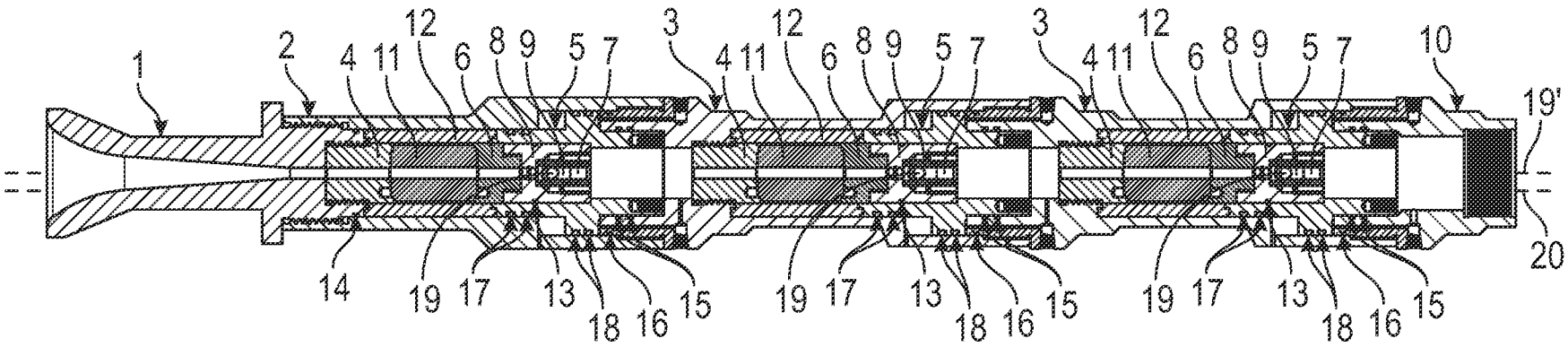
FIG. 1 includes a cross-sectional view of a packoff in an embodiment.

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photo, may appear different while still incorporating the claimed structures of the illustrated embodiments (e.g., walls may not be exactly orthogonal to one another in actual fabricated devices). Moreover, the drawings may only show the structures useful to understand the illustrated embodiments. Additional structures known in the art may not have been included to maintain the clarity of the drawings. For example, not every layer of a device is necessarily shown. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A or B" include situations with A, B, or A and B.

Applicant noted that in the past decade, the wireline operation itself has changed in order to accommodate the increase in drilling of longer horizontal wells. Pump down perforating is a wireline-conveyed method of completing horizontal wells and has become one of the most widely used completion techniques in recent years. Composite plugs and perforating guns are lowered into the wellbore by pumping fluid from the surface to force the tools into the horizontal section of the well. Once the desired depth is reached, the plug is set and guns are fired, creating holes through the casing and cement and into the formation. The newly created perforations provide reservoir access for the subsequent hydraulic fracturing operations. Two of the main components of the pumpdown operation itself is the wireline cable and the pressure control equipment that supports it.

Applicant determined the wireline operation has a number of limiting factors which can alter the outcome and execution of the job. The cable itself presents the majority of such limiting factors. A traditional wireline cable contains a central insulated conductor surrounded by two layers of wire armors that are wrapped around the conductor to create a wireline cable. Traditional pressure control equipment utilizes a grease injection method to maintain a pressure seal as high viscosity grease is pumped into and around the armors as the cable is brought through small diameter flow tubes. Applicant noted that as market demand increases and the industry advances into eco-friendlier methods, operations have now moved to a new version of wireline cable that is mainly characterized by its coating (known as greaseless, coated, or jacketed cable).

Coated cable consists of armor wires that are embedded into a polymer jacket characterized by a smooth profile. Such a cable has rapidly become the predominant cable used in wireline operations in the USA, as it provides many economical and operational advantages. Coated cable allows for limited pressure control equipment, eliminates or lowers the need for grease injection, enables faster running speeds, allows for the completion of longer well laterals, and faster rig-up/rig-down times. As the shift in technology occurs, Applicant determined the industry requires a change in technology for the rest of the pressure control equipment in use, mainly the packoff (or "pack off").

Generally, a packoff assembly may be used in operations, such as a wireline perforating operation. Packoffs provide a means for safe pressure control while adding and/or removing tools into and out of a wellbore. A packoff is one of the most critical components in greaseless operations, as it has replaced various components of conventional pressure control equipment. The packoff holds an active seal around the wireline, allowing the wireline to travel safely in and out of the well while containing well pressure and preventing fluids and/or gases from escaping to the surface. Additionally, the proper design and use of packoff assemblies further contribute to extending the life of the cable in use.

Various embodiments addressed herein are designed for greaseless operations (i.e., grease is not injected by an operator to be directly adjacent the wireline and thereby seal pressure about the wireline) and replace the conventional grease head, flow tubes, line wipers, and stuffing boxes that work in combination with conventional wireline cable. A packoff assembly presented herein consists of a slim body design with a bell housing for proper cable alignment and improved material selection of metal bushings and rubber for cable longevity and support. The bushings guide the cable though the rubber elements, further promoting less cable damage and wear. Embodiments additionally present a pressure transducer system that allows for the appropriate amount of packoff pressure, thereby increasing operational durability of the packoff and/or wireline. Embodiments additionally present one or more velocity check-valves that prevent fluid from escaping the well and maintain pressure control in the event that the wireline is removed from the packoff under pressure. Thus, as the oil and gas industry grows and shifts to greaseless operations and jacketed wireline cables in compliance with zero spill goals, embodiments address herein satisfy a need for pressure control equipment designed for use of greaseless cables in high pressure operations.

An embodiment includes a greaseless triple packoff, that is hydraulically operated and capable to withstand up to 15,000 psi of pressure. It consists of an injection-less system (i.e., no need to inject grease onto the wireline (to pressure seal the wireline) or between the packoff element sections) and a threaded brass or metal insert system that incorporates multiple technological improvements over previous generations and designs. Embodiments avoid unnecessary pressure within the packoff elements, therefore preventing pre-mature wearing of the rubbers. Such an embodiment consists of a slim body design with a bell housing assembly, internal rubber and rubber sleeve assemblies, and threaded metal inserts (e.g., bushings) instead of the commonly used floating brass inserts. By diverging from the floating brass components, the design presents a major operational, technical, and economical advantage from the user point of view. Some of the brass (or, more generally, metal) inserts (e.g., the inserts directly adjacent the pistons) may couple with the pistons via a threaded fitting. Such a coupling helps prevent damage to the wireline cable. Additionally, some embodiments are atmospherically valved or ported to handle adiabatic pressure events and contains three velocity check valves.

An embodiment includes a transducer system between elements, which provides a real time indication of abnormal pressure changes in order to prevent (a) damage to the wireline, and/or (b) fluid to pass and release from the packoff. A goal of the transducers is simply to detect pressure. Feedback is sent to the wireline unit via an electric cable or wireless communication method that will indicate what pressures the packoff rubbers are being exposed to and, for example, if any pressure is making it past the packoff element. Accordingly, this feature will further extend the life of the assembly by allowing each rubber to be used only as it is needed. In a straightforward manner, when packoff "a" is ready to give out and can no longer hold pressure by itself, such a condition will be communicated to the user, indicating that packoff "b" is now ready to be operational, and so forth.

An embodiment includes a pressure gauge and hydraulic fluid volume gauge on the packoff which provide a real time indication of the use and useful life remaining on the packoff elements. Feedback is sent to the wireline unit via an electric cable or wireless communication method that will indicate what pressure the packoff elements have applied and what volume of fluid has been utilized to maintain a packoff seal. Accordingly, this feature will further extend the life of the assembly by allowing each rubber to be used only as it is needed. In a straightforward manner, when packoff "a" is ready to give out and will exceed its maximum pressure or exceed the high end of the displacement volume of hydraulic fluid used by itself, such a condition will be communicated to the user, indicating that packoff "b" is now ready to be operational, and so forth.

Finally, the robust design of packoff assembly embodiments improve operations by minimizing the need for maintenance and the ease of configuration will lower operational mistakes during its use.

The following examples pertain to further embodiments.

Example 1: A greaseless wireline triple packoff, comprising: an injection-less system, a slim body with bell housing design, metal bushings, wherein the packoff is rated for high pressure operations (e.g., 15,000 PSI).

For example, the packoff assembly of FIG. 1 includes sections, each including a piston 5 that slides to force a ball check body 8 and lower bushing 6 towards rubber 11 and sleeve 12. The sliding of the piston towards bell housing 1 compresses rubber 11 against upper bushing 4 to squeeze the rubber and thereby decrease the diameter of its inner passage. This presses the rubber against the wireline to form a pressure resistant seal. Considering the "triple" nature of the packoff, various advantages are achieved. For example, in FIG. 1 the right-most packoff ("bottom" packoff) may be closest to the wellbore and the left-most packoff ("top" packoff) is further from the wellbore (with a "middle" packoff between the top and bottom packoffs). In operation, each of the packoffs may be operated independently from one another. For example, adaptor 10 (e.g., pressure control equipment (PCE) adaptor) includes a hydraulic port to supply fluid (e.g., hydraulic fluid) to the piston to drive the piston upward and seal the rubber around the wireline. However, similar ports are included in mid housing 3 for each of the middle and upper packoffs. In operation, an operator may operate hydraulic fluid supplies to only close the bottom packoff while leaving the middle and top packoffs in a relatively open state. However, should the rubber of the bottom packoff deteriorate or the bottom packoff fail to adequately seal the wireline for any reason, either or both of the middle or top packoffs can be closed instead of or in addition to faulty or insufficient bottom packoff. While embodiments show three packoffs, other embodiments may include a single packoff, two packoffs, four packoffs, or more. FIG. 1 further includes gaskets, such as O-rings 13, 14, 15, 16, 17, 18.

The embodiment of FIG. 1 is "greaseless" or "injectionless" in that there is no means for grease injection by the operator into the channel to contact the wireline with grease to create a pressure seal.

In an embodiment, top and/or bottom bushings 4, 6 may be brass but in other embodiments other metals or alloys may be used such as stainless steel and the like. Such bushings may couple to the system via threaded couplings but in other embodiments other couplings (e.g., pressure or resistance fit, floating, and the like) are used.

Figure 11:
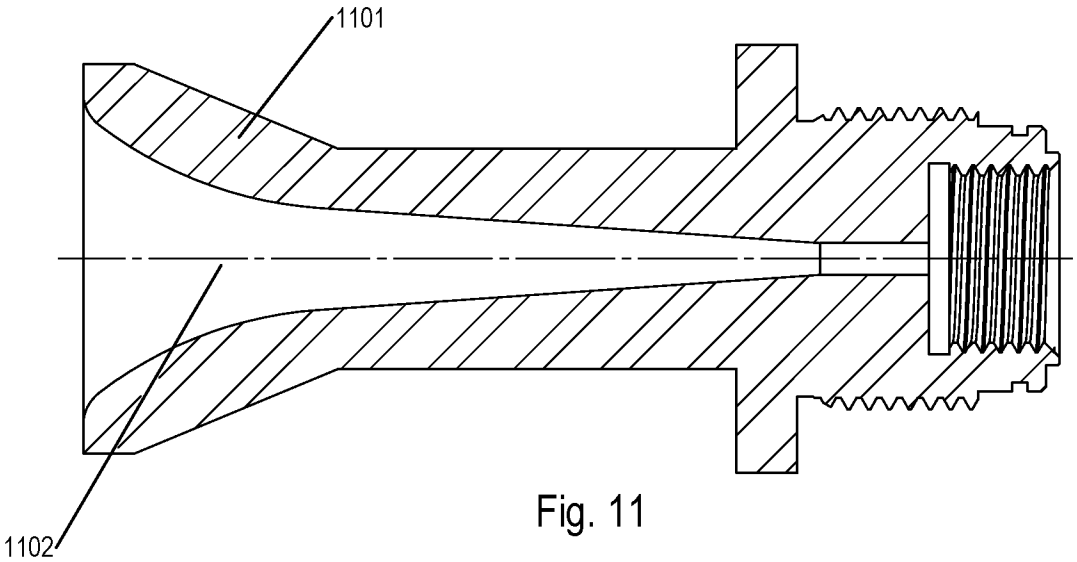
FIG. 11 includes a cross-sectional view of a bell housing in an embodiment.

As mentioned elsewhere herein, bell housing 1 (see FIG. 1) may facilitate the channeling of the wire line to the packoff with decreased wear on the wireline. Bell housing 1 may couple to mid housing 3 via upper housing 2. In the embodiment of FIG. 11, the bell housing's 1101 channel 1102 tapers or narrows as the channel extends towards the trio of packoffs (not shown but would be located to the right in FIG. 11).

Example 2: The device of example 1, which is hydraulically and remotely operated.

For instance, on conventional systems any hydraulic line to any of the hydraulic ports of elements 3, 10 may be a relatively long line (e.g., greater than 20-30 feet in length) to reach a pump located on or near the ground. However, in an embodiment the pumps with which to pump the hydraulic fluid to the hydraulic ports may instead be located within 2 to 3 feet of the packoff assembly (i.e., raised in the air) thereby allowing for relatively shorter hydraulic lines. Such a pump (which may be used for all three packoffs) or pumps (whereby different pumps are used for different packoffs) may be manually operated or remotely operated.

Example 3: The device of example 1, wherein all three packoffs are considered primary barriers; in order from bottom-most to top-most.

As mentioned above, each packoff may be used independently of the other packoffs to independently seal the wireline.

Example 4: The device of example 1; wherein line rubbers and rubber sleeves provide a reliable seal on the cable.

Thus, elements 11, 12 may be include rubber or a resilient polymer or polymers that may be compressed to seal against the wireline. Elements 11, 12 may include a rubber such as, for example, XNBR (90 durometer). XNBR is a nitrile rubber with the addition of a carboxyl group to saturate the butadiene segment of the carbon polymer backbone. The added carboxyl group greatly improves the resistance of then nitrile rubber to abrasive and tear wear without affecting its oil and solvent resistance or its thermal stability. Sleeve 12 may encase or cooperate with a resilient member, such as a spring (not visible in FIG. 1), to help drive the piston downwards once hydraulic pressure is lessened and the piston is no longer forced upwards.

Example 5: The device of example 1; wherein metal inserts are utilized instead of brass, providing longer life of the inserts themselves. As a result, the packoff needs to be "rebuilt" or refurbished less frequently (leading to time and costs savings).

As used herein, a "metal insert" concerns either or both of the bushings 4, 6.

Example 6: The device of example 1 comprising a bell housing design for cable alignment preventing cable wear due to the angle/positioning of the line with respect to the wellhead.

Example 7: The device of example 1, wherein the device does not contain a grease chamber between or below the packoff elements but may be ported for throttled or valved pressure relief capability (via a valve) to handle adiabatic heating operations.

Figure 6:
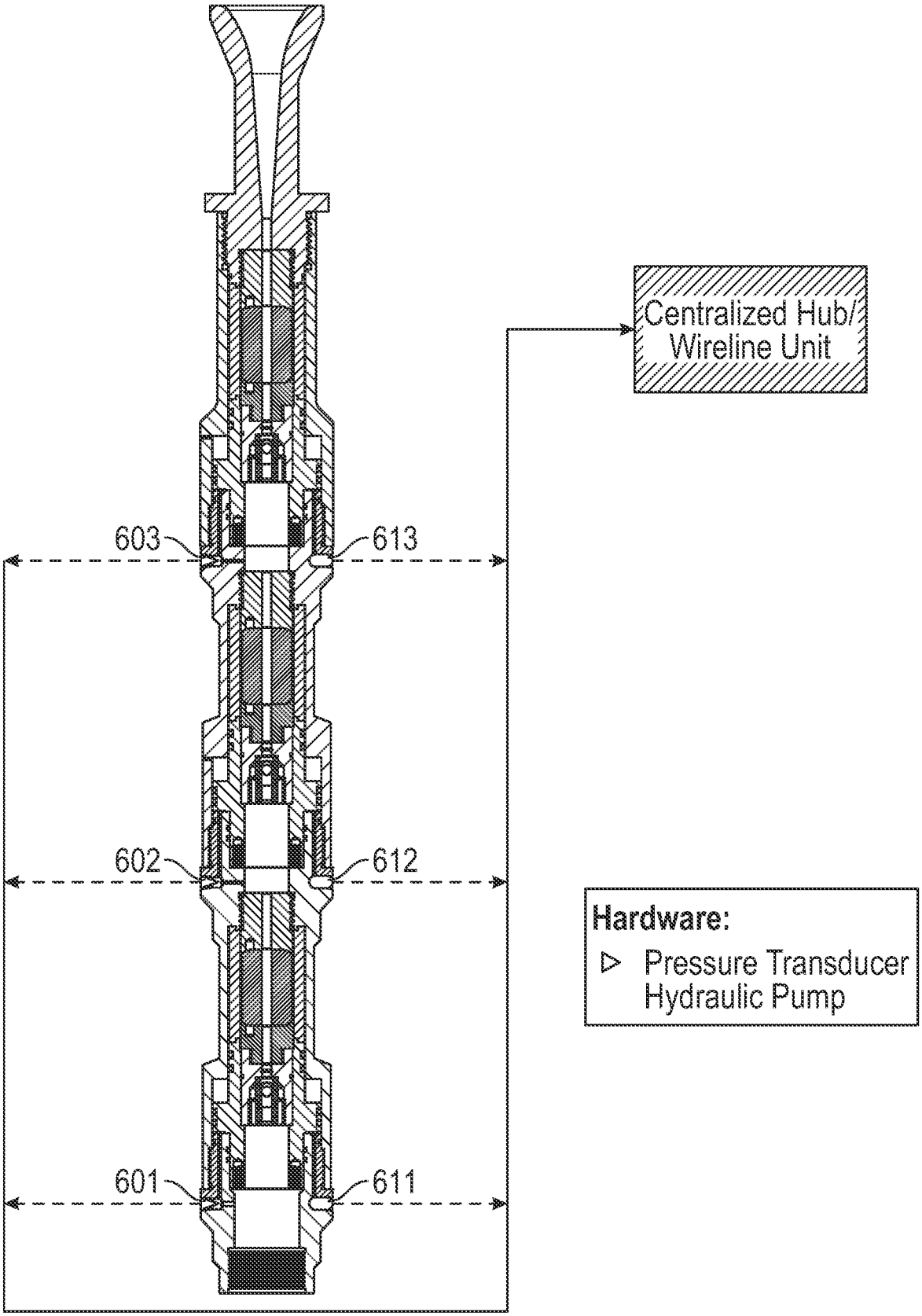
FIG. 6 includes a cross-sectional view of a packoff in an embodiment.

For example, each of elements 3, 10 include a port opposite the previously described hydraulic ports. These ports may open the wireline channel to atmosphere to vent compressed gases and thereby alleviate adiabatic heating operations. Further, such ports may be coupled to pressure sensors (such as pressure transducers) and control valves. As a result, pressure may be monitored just below the piston of the bottom packoff, just below the piston of the middle packoff, and/or just below the piston of the top packoff. For example, in FIG. 6 transducers 601, 602, and 603 sense pressures generated (indirectly) by hydraulic pumps 611, 612, 613. They may communicate with a centralized hub/wireline unit to perform operations such as those detailed in FIG. 7. Regarding the above-mentioned venting, in FIG. 8 transducers 801, 802, and 803 sense pressures generated (indirectly) by hydraulic pumps 801, 802, 803. They may communicate with a centralized hub/wireline unit to perform operations such as those detailed in FIG. 7. Further, vent valve 804 may open the wireline channel to atmosphere to vent compressed gases and thereby alleviate adiabatic heating operations.

An operator may, for example, sense elevated pressure at the location below the piston of the bottom packoff. The operator may choose to supply hydraulic fluid to the bottom packoff to seal the wireline. The operator may consequently expect to sense a pressure reduction below the middle packoff piston and/or below or above the upper packoff piston. Or in the instance of utilizing the middle packoff, the operator may expect to sense a pressure reduction below or above the top packoff piston. If such a pressure reduction fails to occur, the operator may determine rubber 11 of the bottom packoff has failed to properly seal the wireline and the operator may then choose to raise the piston of the middle packoff and/or other upstream packoff. In some embodiments, the ability to detect a pressure differential between different packoffs may be automated to quickly raise a piston of an additional packoff when a first packoff fails to adequately pressure seal the wireline. For example, see FIG. 7.

Figure 7:
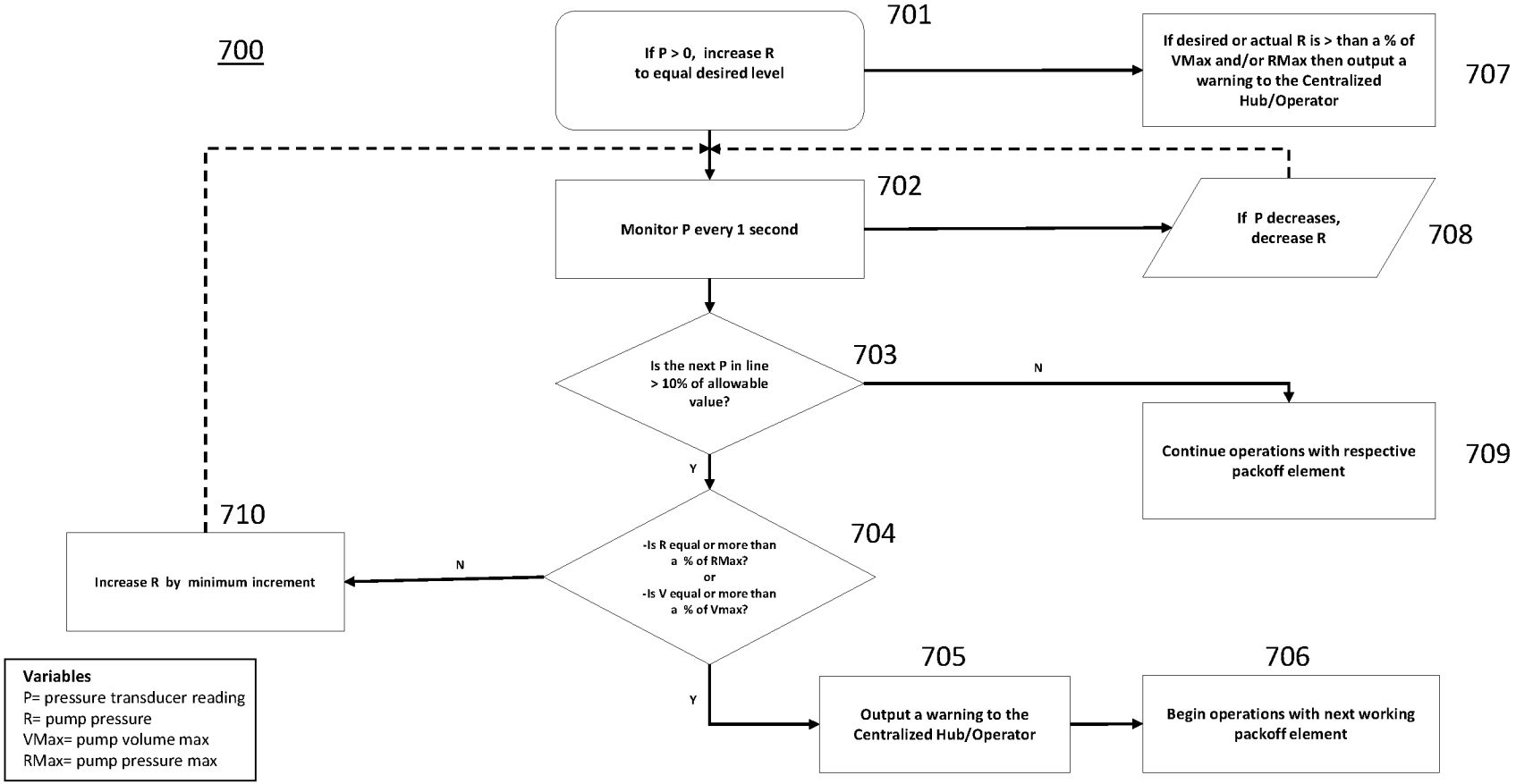
FIG. 7 includes a method in an embodiment.
Figure 8:
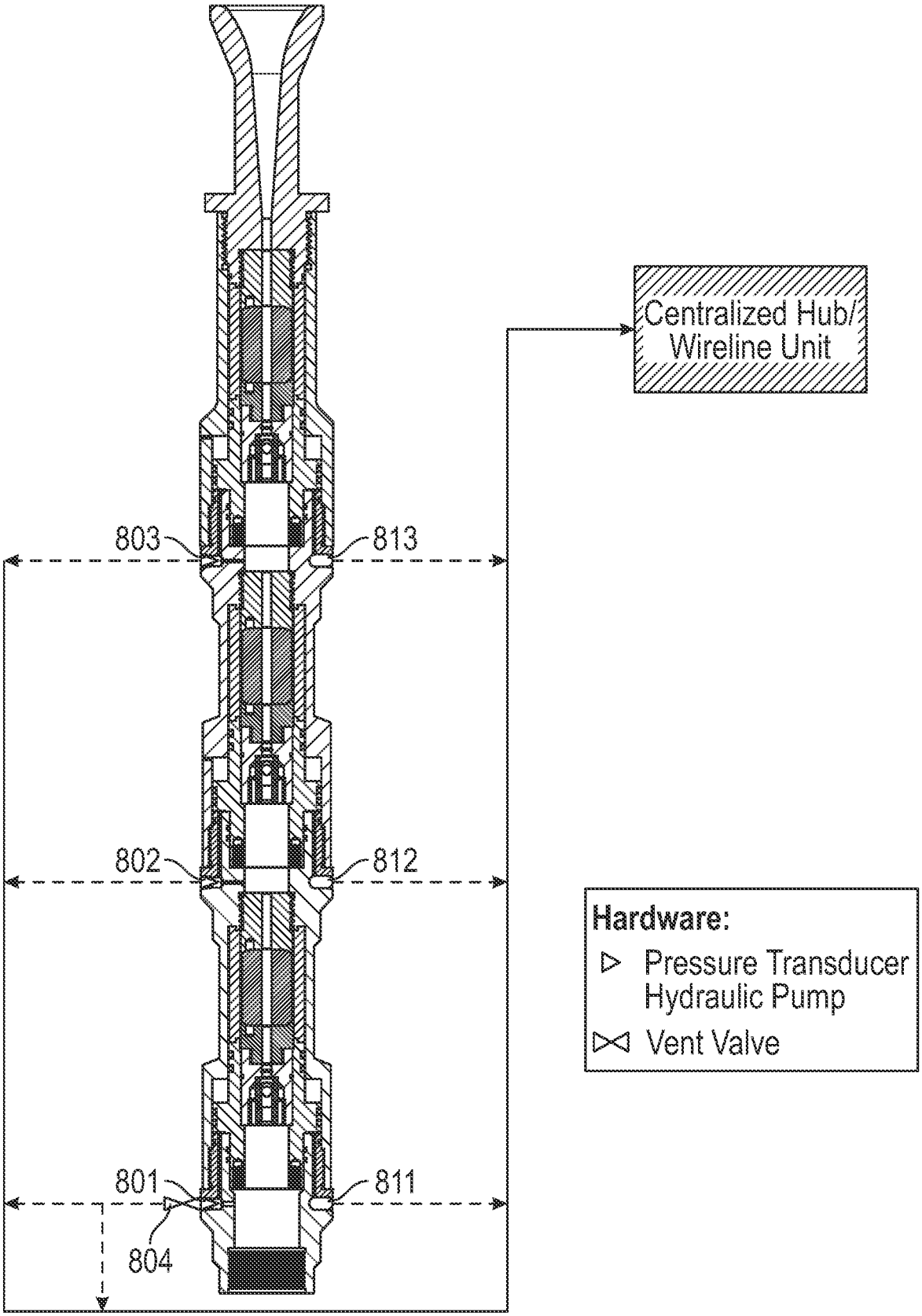
FIG. 8 includes a cross-sectional view of a packoff in an embodiment.

FIG. 7 includes process 700. At block 701, a pressure reading is made via a transducer, such as the transducer below the bottom packoff unit (closest to the wellbore) of FIG. 6. See, e.g., transducer 601 of FIG. 6 (which may measure well pressure). While not necessarily shown in FIG. 7, logic (e.g., software) may assess if the packoff seal is closed (due to pressure read at subsequent or upstream transducers reading above 0) and then utilize a hydraulic pump to pressure (or further pressure) the piston of the first packoff to a target pressure. This step (or portions thereof) may be in addition to other steps shown in FIG. 7 but, like other steps in FIG. 7, is not necessarily required in all embodiments. Returning to block 701, if the measured pressure is greater than zero (or some other threshold), a target pressure for a packoff pump to seal the bottom packoff may be calculated in various ways including, for example, A*P (A=ratio of pump pressure, P=Pressure at the transducer) or B (B=manually defined pump pressure). For example, pressure may be used from pump 611 (FIG. 6) to seal collar 11 of the lowest packoff via piston 5 of FIG. 1. If the pump that powers the first packoff must work beyond a predetermined threshold to achieve the desired pressure (e.g., block 707), this may be indicative of possible collar wear. More specifically, in block 707 an operator may set bounds for various parameters. The bounds may be based off variables, such as those listed in FIG. 7 (e.g., P, R, etc.). The bounds may include, for example, a percentage of Vmax (pump volume max) and/or a percentage of RMax (pump pressure max) for pump 611. If efforts to produce the pressure of block 701 result in violation of the bounds of block 707, then a warning may be generated for the operator alerting him or her to the violation. Such a condition may be indicative of a failing collar in the packoff. The violation of bounds may be determined based on a projection that a violation will occur or may be determined that a violation has already occurred. Block 701, in other words, addresses an initial condition or goal and block 707 addresses bounds within which block 701 may proceed.

In block 702 monitoring occurs. However, as addressed in block 708, if transducer or well pressure (e.g., sensed by transducer 601) decreases by a certain amount (e.g., DeltaP) or rate, then the running pressure R of the packoff pump can be decreased (e.g., possibly the pumping pressure for pump 611 is too high). For example, the pressure monitored may be a pressure measured by transducer 601, 602 and/or 603. If that pressure drops, pump 611 may be set to run at a lower pressure, potentially extending its operating life. The desired lower pressure may be, for example, decreased by a value equal to A*DeltaP, where A=0.1. However, this is just an example and other values for A may be used according to the operator's discretion.

In block 703, a pressure transducer further/upstream from the wellhead is monitored. For example, if block 701 pertains to transducer 601 then block 703 may pertain to transducer 602 and/or 603. If the "upstream" transducer registers a pressure below a threshold (less than equal to 10% of a threshold) this may be indicative that the bottom seal is working as intended (block 709). However, if the pressure at the upstream transducer is above the desired threshold, in block 704 further parameters are checked and, if within or below a certain threshold, packoff pressure may be increased (block 710). For instance, if R is less than a percentage of RMax (and/or V is less than a percentage of Vmax), block 710 may increase the pressure applied by pump 611 (and/or pumps 612, 613) by a minimum increment (e.g., 100 psi). For example, if pressure is leaking past the lowest or most downstream collar, pump 611 may increase the pressure to better seal the collar (provided doing so does not violate operating conditions for pump 611).

However, if the parameters are out of a desired range, blocks 705, 706 may lead to an operator (or automated logic) employing an additional packoff unit or element to properly seal the wireline.

Method 700 may be repeated continuously and, for example, block 701 may pertain to any of transducers 601, 602, 603 (e.g., possibly applies to transducer 601 until a more upstream packoff is used to seal wireline).

Example 8: The device of example 1, wherein check valves are utilized in the event of abnormal operation where pressure control has been lost due to the wireline being removed from the packoff.

For instance, in FIG. 1 ball check body 8, ball valve body 9, and check valve insert 7 collectively provide a check valve. For example, a movable part such as ball 19, is moved into a side chamber by a wireline. Such a side chamber is visible in FIG. 2 (which shows ball valve body 209 in detail). However, if the wireline is removed from the packoff assembly channel for any reason (e.g., wireline is removed from well bore or is severed within the wellbore), elevated wellbore pressure and fluid passing the ball will evict the ball from the side chamber and drive it into the main channel to perform as a check valve.

Example 9: The device of example 1; wherein said invention does not require the use of additional grease to hold a seal on the wireline.

Example 10: A transducer system, which is an added feature to said device in example 1, to monitor abnormal pressure changes within the element, comprising of: a stainless-steel housing and ¼ inch male thread fitting OR a wiring assembly; a removable assembly positioned in between the packoffs, that provides a digital reading via an electric cable to the wireline unit, laptop, or separate signal receiving device; an elastic material that deforms when exposed to wellbore pressure and an electrical device which detects the undergoing deformation and converts it into an electrical signal.

Embodiments may use remotely operated pumps (e.g., electric or manual) to close the packoff elements. Such an embodiment may monitor pressure between elements (via the port opposite the hydraulic ports in elements 3, 10) and based on pressure use semi-automated or fully automated logic to control packoff pressure. In addition, via these same ports, the embodiment may monitor fluid volume used at a packoff to analyze life of each individual packoff. For example, samples may be taken that look for debris or deterioration of rubber element 11 based upon a change in fluid volume or packoff pressure. Further, based on an operator's predetermined bypass pressure (pressure differences between transducers) and/or a predetermined element life (based on runs or fluid volumes or pressure the element has been exposed to), the packoff can autonomously or semi-autonomously bypass a nearest working packoff and engage the next working packoff up the tree or down the tree. Further, electric run packoff elements may be operated via wired connection, battery power, and/or Wi-Fi-Bluetooth-nearfield communication. Information from the above is transmitted back to a local and centralized communication portal for monitoring and decisions Example 1a. A greaseless wireline triple packoff, comprising: an injection-less system, with a bell housing design, metal bushings, rated for high pressure operations.

Example 2a. The device of example 1a; wherein all three packoffs are considered primary barriers.

Example 3a. The device of example 1a; wherein line rubbers and rubber sleeves Y provide a reliable seal on the cable.

Example 4a. The device of example 1a; wherein metal inserts are utilized instead of brass, providing longer life of the cable in use.

Such metal inserts may include at least one of chromium, molybdenum, manganese, or combinations thereof. Inserts may include steel, iron alloys, and the like.

Example 5a. The device of example 1a; wherein the device includes a bell housing design for cable alignment preventing cable wear due to the angle/positioning of the line with respect to the wellhead.

Example 6a. The device of example 1a; wherein said invention does not contain a grease chamber between packoff elements but is ported for injection/bleed off, and/or monitoring capability to handle adiabatic heating operations as well as monitoring of pressure.

Example 7a. The device of example 1a; wherein said device does not require the use of additional grease to hold a seal on the wireline.

Example 8a. A transducer system, which is an added feature to said device in example 1, to monitor abnormal pressure changes within the element. This system has transducers before the bottom packoff and between each packoff element and, in some embodiments, above the top packoff element.

Example 9a. A localized pump system that does not require pressure hoses that go back to the ground or wireline unit.

For instance, see FIG. 11A. A hydraulic pump or pumps may be located adjacent an embodiment of a greaseless packoff. The pump or pumps may be coupled to the packoff, be suspended form the crane/derrick, and the like. Doing so will reduce pump size and overall congestion near the jobsite.

Example 10a. Automated logic and control of the packoff elements based off of the transducer readings or packoff readings, or a combination of the packoff and transducer readings and operations at hand.

Example 1b. A pressure control system for sealing a wireline comprising: a first pressure control section comprising: (a) a first upper bushing and a first lower bushing; (b) a first resilient sealing member, which is between the first upper bushing the first lower bushing, including a first channel to receive a wireline; (c) a first resilient sleeve that substantially surrounds the first resilient sealing member; and (d) a first piston coupled to a first port; a second pressure control section comprising: (a) a second upper bushing and a second lower bushing; (b) a second resilient sealing member, which is between the second upper bushing the second lower bushing, including a second channel to receive the wireline; (c) a second resilient sleeve that substantially surrounds the second resilient sealing member; and (d) a second piston coupled to a second port; a third pressure control section comprising: (a) a third upper bushing and a third lower bushing; (b) a third resilient sealing member, which is between the third upper bushing the third lower bushing, including a third channel to receive the wireline; (c) a third resilient sleeve that substantially surrounds the third resilient sealing member; and (d) a third piston coupled to a third port; wherein each of the first, second, and third pistons is respectively configured to slide, independently of one another and non-simultaneously with each other, towards the first, second, and third resilient sealing members to respectively compresses the first, second, and third resilient members and consequently seal the first, second, and third resilient sealing members around the wireline.

In an embodiment, one or more of the bushings is threaded into place. However, in other embodiments the bushings (or a subset thereof) may be coupled to the system via a resistance fit or other coupling means. In an embodiment, both of the first upper bushing and the first lower bushing are threaded into place. However, in other embodiments only one of the first upper bushing and the first lower bushing is threaded into place. The same may be true for other bushings in the system.

Figure 12:
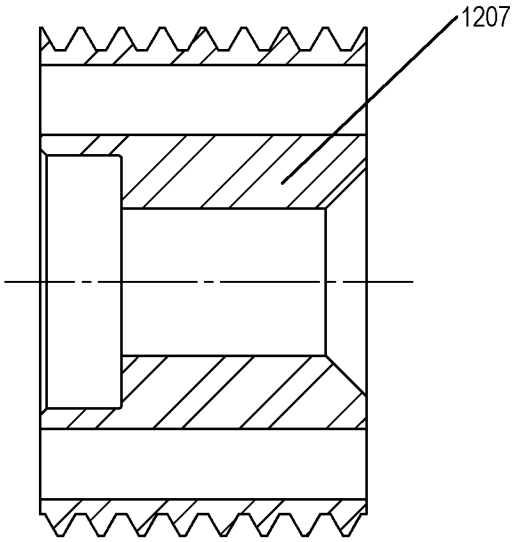
FIG. 12 includes a cross-sectional view of a check valve insert in an embodiment.
Figure 13A:
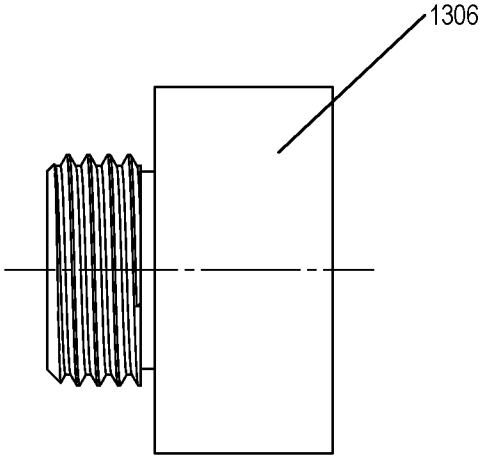
FIG. 13A includes a side view of a lower bushing in an embodiment.
Figure 13B:
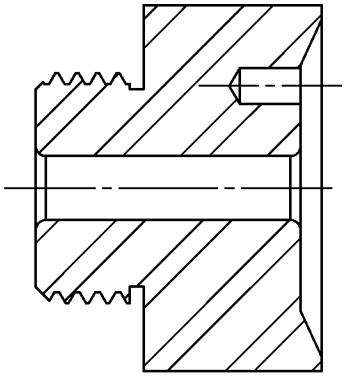
FIG. 13B includes a cross-sectional view of a lower bushing in an embodiment.
Figure 14A:
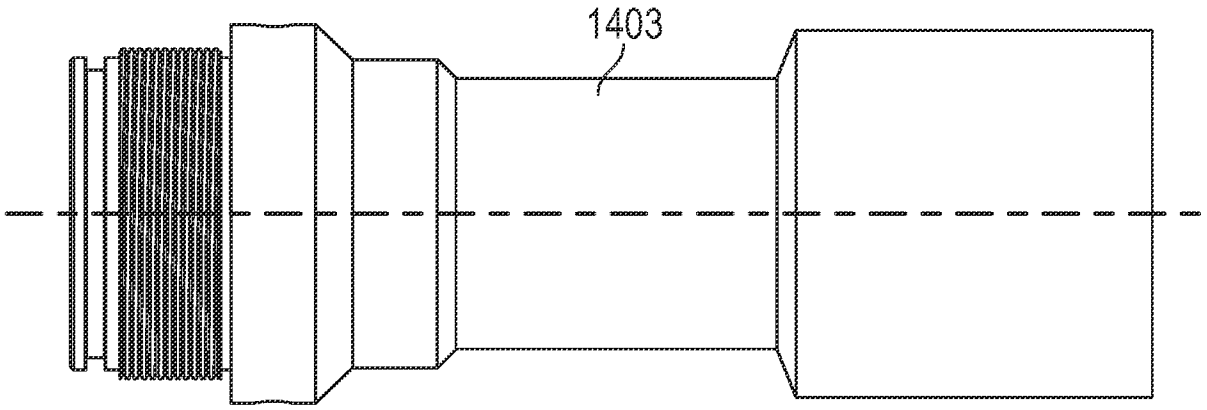
FIG. 14A includes a side view of a mid-housing in an embodiment.
Figure 14B:
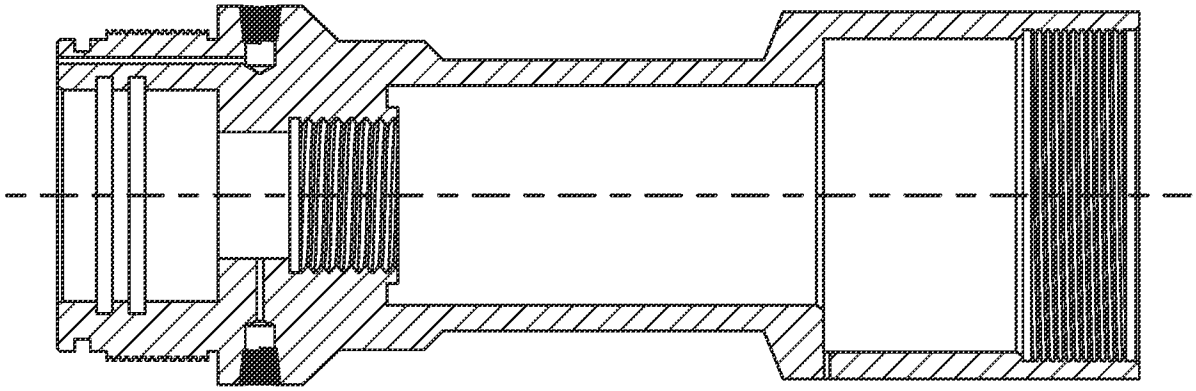
FIG. 14B includes a cross-sectional view of a mid-housing in an embodiment.
Figure 15A:
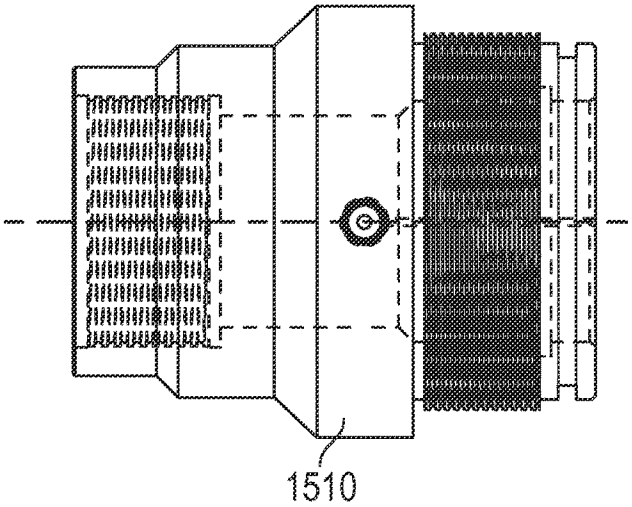
FIG. 15A includes a side view of an adaptor in an embodiment.
Figure 15B:
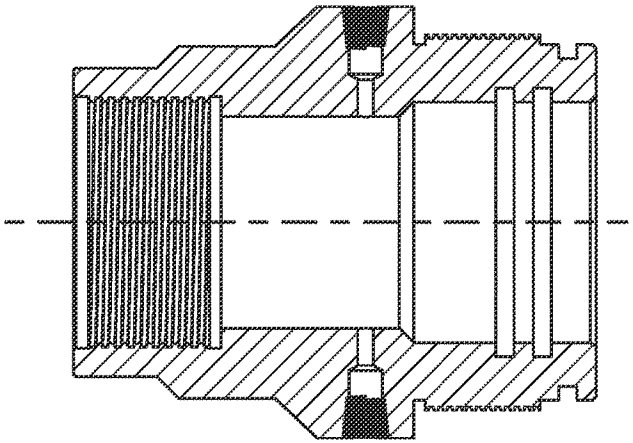
FIG. 15B includes a cross-sectional view of an adaptor in an embodiment.
Figure 16:
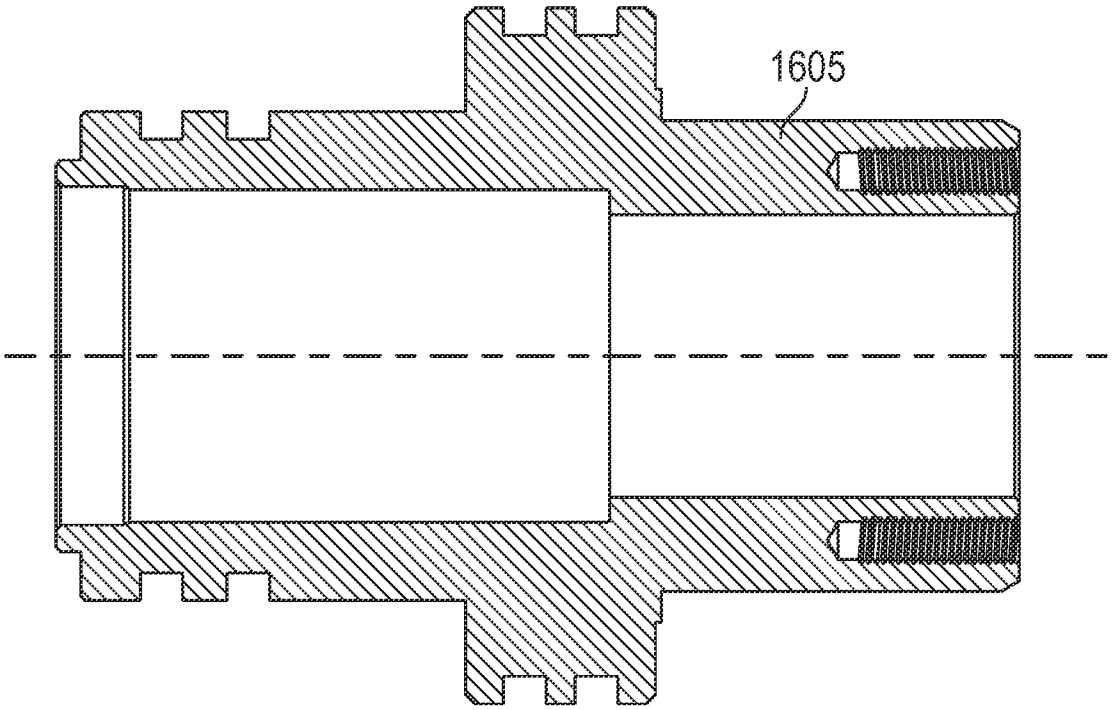
FIG. 16 includes a cross-sectional view of a piston in an embodiment.
Figure 17:
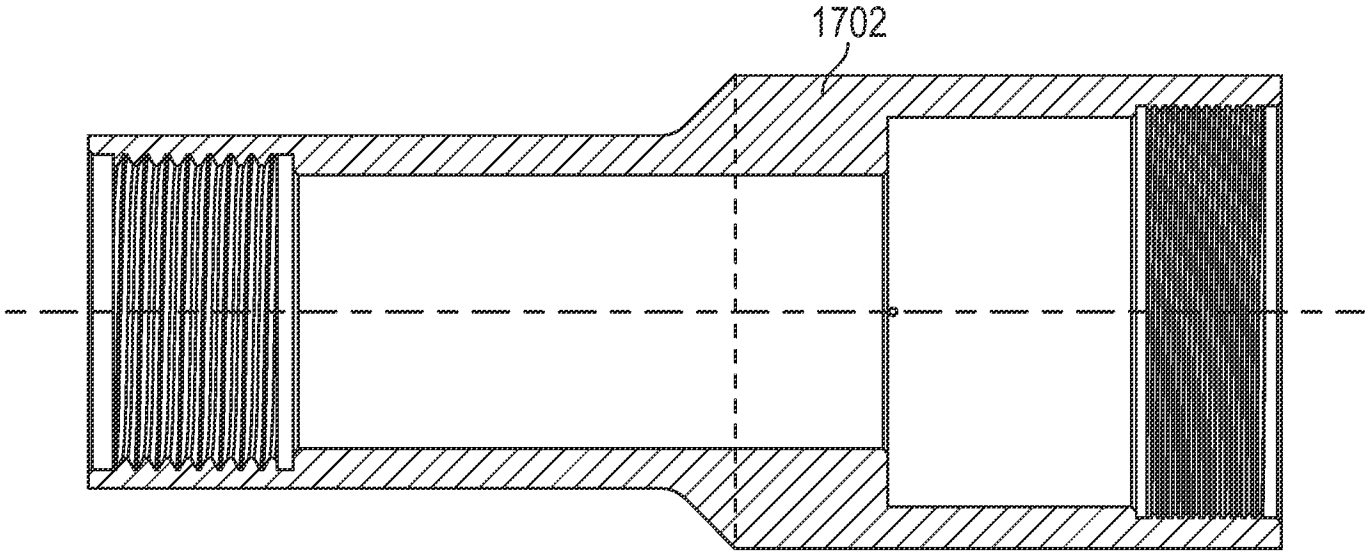
FIG. 17 includes a cross-sectional view of an upper body housing in an embodiment.
Figure 18A:
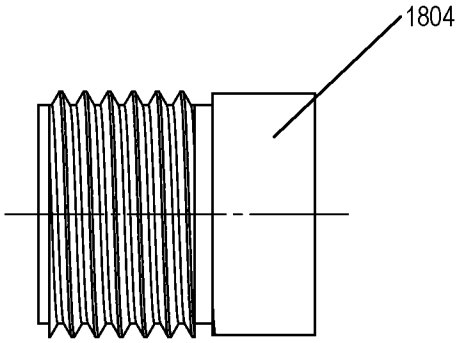
FIG. 18A includes a side view of an upper busing in an embodiment.
Figure 18B:
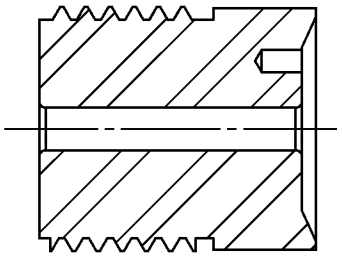
FIG. 18B includes a cross-sectional view of an upper bushing in an embodiment.

FIGS. 13A and 13B provide side and cross-sectional views of lower bushing 1306. FIGS. 18A and 18B provide side and cross-sectional views of upper bushing 1804. FIGS. 14A and 14B provide side and cross-sectional views of lower bushing 1403. FIGS. 15A and 15B provide side and cross-sectional views of adaptor 1510. FIG. 16 provides a cross-sectional view of piston 1605. FIG. 17 provides a cross-sectional view of upper body housing 1702. FIGS. 2 and 10 through 18B are more detailed embodiments of analogous devices shown in FIG. 1.

While certain embodiments disclose a triple packoff having three pressure control sections, other embodiments may include two pressure control sections (e.g., the first and second pressure controls sections of Example 1 but not the third pressure control section of Example 1) or four or more pressure control sections. Having multiple sections allows degradation to be "spread out" over multiple sections so that when one resilient member is failing other resilient members can be used instead of spending the time and expense to breakdown the device and replace the failing resilient sealing member. Further, the multiple sections also provide redundancy which promotes greater safety considering the high wellbore pressures experienced by the system.

As used herein, the phrase "wherein each of the first, second, and third pistons is respectively configured to slide, independently of one another and non-simultaneously with each other" does not exclude the ability for each of the first, second, and third pistons to respectively slide independently of one another but simultaneously with each other. Further, "simultaneously" does not necessarily mean each piston begins movement at the exact same second and stops movement at the exact same moment.

Further, "seal" does not necessarily mean a perfectly complete seal whereby no fluid passes between the resilient sealing member and the wireline.

Alternative version of Example 1b. A pressure control system for sealing a wireline comprising: a first pressure control section comprising: (a) a first bushing; (b) a first resilient sealing member, which is adjacent the first bushing, including a first channel to receive a wireline; (c) a first resilient sleeve that substantially surrounds the first resilient sealing member; and (d) a first piston coupled to a first port; a second pressure control section comprising: (a) a second bushing; (b) a second resilient sealing member, which is adjacent the second bushing, including a second channel to receive the wireline; (c) a second resilient sleeve that substantially surrounds the second resilient sealing member; and (d) a second piston coupled to a second port; a third pressure control section comprising: (a) a third bushing; (b) a third resilient sealing member, which is adjacent the third bushing, including a third channel to receive the wireline; (c) a third resilient sleeve that substantially surrounds the third resilient sealing member; and (d) a third piston coupled to a third port; wherein each of the first, second, and third pistons is respectively configured to slide, independently of one another and non-simultaneously with each other, towards the first, second, and third resilient sealing members to respectively compresses the first, second, and third resilient members and consequently seal the first, second, and third resilient sealing members around the wireline.

Thus, not all embodiments require both a top and bottom bushing in each pressure control section. Some may include one a single bushing above or below the resilient sealing member.

Alternative version of Example 1b. A pressure control system for sealing a wireline comprising: a first pressure control section comprising: (a) a first upper bushing and a first lower bushing; (b) a first resilient sealing member, which is between the first upper bushing the first lower bushing, including a first channel to receive a wireline; and (c) a first piston coupled to a first port; a second pressure control section comprising: (a) a second upper bushing and a second lower bushing; (b) a second resilient sealing member, which is between the second upper bushing the second lower bushing, including a second channel to receive the wireline; and (c) a second piston coupled to a second port; a third pressure control section comprising: (a) a third upper bushing and a third lower bushing; (b) a third resilient sealing member, which is between the third upper bushing the third lower bushing, including a third channel to receive the wireline; and (c) a third piston coupled to a third port; wherein each of the first, second, and third pistons is respectively configured to slide, independently of one another and non-simultaneously with each other, towards the first, second, and third resilient sealing members to respectively compresses the first, second, and third resilient members and consequently seal the first, second, and third resilient sealing members around the wireline.

Thus, some embodiments do not necessarily include resilient sleeves. Such sleeves may aid in retuning a pressure control section to an unsealed state but other methods may be used to accomplish the same task. For example, such sleeves may include a resilient member, such as a spring, that is compressed when the section is in a sealed state. Such a spring is still considered a "sleeve" as used herein. Further, the spring or resilient member may be encased or within a polymer. Without such a sleeve, other embodiments may use additional hydraulic ports to lower or unseal the section.

Example 2b. The system of Example 1b, wherein: a wireline axis (19') extends through the first channel, the second channel, and the third channel; a first axis (20), which is parallel to the wireline axis, extends through (a) the first, second, and third upper bushings, (b) the first, second, and third lower bushings, and (c) the first, second, and third resilient sealing members; and a second axis, which is parallel to the first axis, extends through (a) the first, second, and third resilient sleeve members, and (b) the first, second, and third pistons.

Example 3b. The system according to any of Examples 1b-2b, wherein: the first port is configured to couple to a fluid source; and the first piston is configured to alternatively slide towards and away from the first resilient sealing member to alternatively seal and unseal the wireline in response to fluid respectively entering and exiting the first port.

Such a fluid source may include, for example, hydraulic fluid.

Example 4. The system according to any of Examples 1b-3b comprising: a first void between the first piston and the second upper bushing; a second void between the second piston and the third upper bushing; a third void below the third piston; a first auxiliary port coupled to the first void; a second auxiliary port coupled to the second void; and a third auxiliary port coupled to the third void; wherein the first port is not coupled to the first void, the second port is not coupled to the second void, and the third port is not coupled to the third void.

For example, in FIG. 1 a transverse axis, which is orthogonal to the wireline axis of Example 2b, intersects the second auxiliary port and the second void. The second void will experience heightened pressure if the first resilient sealing member is unsealed or sealed poorly (due to malfunction or fatigue of the first resilient sealing member).

Example 5b. The system of Example 4b comprising at least one pressure sensor coupled to the first, second, and third auxiliary ports.

Example 6b. The system of Example 5b comprising at least one machine-readable medium having stored thereon data which, if used by at least one machine, causes the at least one machine to perform operations comprising: determine a first magnitude of a first pressure in the first void when the first resilient member is in a sealing position and is compressed by the first piston (e.g., see blocks 701 or 702 of FIG. 7); in response to determining the first magnitude of the first pressure, moving at least one of: (a) the second resilient member from an unsealed position to a sealing position by compressing the second resilient member with the second piston, or (b) the third resilient member from an unsealed position to a sealing position by compressing the third resilient member with the third piston.

In an embodiment the logic may be autonomous. For example, the logic (e.g., hardware, software, firmware, or combinations thereof) included in the at least one machine-readable medium may determine the monitored pressure has surpassed a threshold (e.g., higher than a predetermined threshold) (e.g., see block 707 of FIG. 7) and, upon such determination, close or seal a resilient sealing member that is above or below the void where the pressure is sensed (e.g., see block 706 of FIG. 7).

Example 7b. The system of Example 6b, wherein the operations comprise: in response to determining the first magnitude of the first pressure, moving both: (a) the second resilient member from an unsealed position to a sealing position by compressing the second resilient member with the second piston, and (b) the third resilient member from an unsealed position to a sealing position by compressing the third resilient member with the third piston.

In various orientations, one, two, three, or none of the first, second, and third resilient members may be closed or sealing. When one of the resilient members is closed, it is not necessarily the first resilient member and may just as easily be the second or third resilient member.

Example 7.1b The system of Example 6b, wherein the operations comprise: in response to determining the first magnitude of the first pressure (e.g., block 701 of FIG. 7), operating a pump at an activity level to pressure the first void at a target pressure (e.g., block 707 of FIG. 7); comparing the activity level to a threshold activity level (e.g., block 701 of FIG. 7); in response to comparing the activity level to the threshold activity level, moving at least one of: (a) the second resilient member from an unsealed position to a sealing position by compressing the second resilient member with the second piston, or (b) the third resilient member from an unsealed position to a sealing position by compressing the third resilient member with the third piston.

Example 7.11b The system of Example 7.1b, wherein the activity level is based on predetermined pump volume.

Example 7.12b The system of Example 7.1b, wherein the activity level is based on predetermined pump pressure.

Example 7.2b The system of Example 6b, wherein the operations comprise: in response to determining the first magnitude of the first pressure (e.g., block 701 of FIG. 7), determine a second magnitude of a second pressure in the second void (e.g., block 703 of FIG. 7); comparing the second magnitude to a threshold (e.g., block 704 of FIG. 7); in response to comparing the second magnitude to the threshold, moving at least one of: (a) the second resilient member from an unsealed position to a sealing position by compressing the second resilient member with the second piston, or (b) the third resilient member from an unsealed position to a sealing position by compressing the third resilient member with the third piston (e.g., block 706 of FIG. 7).

Example 7.3b The system of Example 6b, wherein the operations comprise: in response to determining the first magnitude of the first pressure (e.g., block 701 of FIG. 7), determine a second magnitude of a second pressure in the second void (e.g., block 703 of FIG. 7); comparing the second magnitude to a threshold (e.g., block 703 of FIG. 7); in response to comparing the second magnitude to the threshold, operating the pump at an increased activity level to pressure the first void at a target pressure (e.g., block 710 of FIG. 7).

Example 7.4b The system of Example 7.3b, wherein the operations comprise: in response to comparing the second magnitude to the threshold, determining whether the pump is operating at an activity level that is greater than a threshold activity level (e.g., block 704 of FIG. 7); in response to determining whether the pump is operating at then activity level that is greater than the threshold activity level, operating the pump at an increased activity level to pressure the first void at a target pressure (e.g., block 710 of FIG. 7).

Example 8b. The system according to any Examples 5b to 7b comprising a valve coupled to the first auxiliary port, wherein: the valve has a plurality of positions; in a first of the plurality of positions the valve couples the first auxiliary port to atmosphere to vent the first void.

This helps with adiabatic conditions where extreme heat due to fluid compression may harm the wireline.

Example 9b. The system of Example 8b, wherein in a second of the plurality of positions the valve couples the first auxiliary port to the first pressure transducer.

Thus, in an embodiment the system (via logic or manual manipulation) may switch between multiple valve positions such that an operator (or autonomous logic) can switch between venting and pressure sensing via a single port. However, in other embodiments a port may be for the venting and another port may be pressure sensing.

Example 10b. The system of Example 5b comprising at least one machine-readable medium having stored thereon data which, if used by at least one machine, causes the at least one machine to perform operations comprising: determine a magnitude of a pressure in one of the first, second, or third voids; in response to determining the magnitude of the pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

For example, the operator may have the first pressure control section closed but the operator may determine pressure sensed by a transducer monitoring the second void may be higher than a predetermined threshold or, simply, higher than the operator would have anticipated. This may indicate the first resilient sealing member is beginning to fail and the seal may be further monitored, maintenance of the first resilient sealing member may be scheduled, and/or the second resilient sealing member may be closed to augment any sealing performed by the first resilient sealing member.

Another version of Example 10b: The system of Example 5b comprising at least one machine-readable medium having stored thereon data which, if used by at least one machine, causes the at least one machine to perform operations comprising: determine a magnitude of a differential pressure present between any two of the first, second, or third voids; in response to determining the magnitude of the differential pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Example 11b. The system according to any of Examples 1b to 10b, wherein the wireline includes a cable coated with a polymer.

Other embodiments may work with non-jacketed cables.

Example 12b. The system of Example 11b, wherein the wireline is greaseless.

Note, for example, in FIG. 1 that the second pressure control section includes a port to deliver hydraulic fluid to the piston and another port to possibly couple a pressure sensor to the void below the second piston. However, there is no port (at least in the embodiment of FIG. 1) to inject grease onto the wireline to promote sealing of the wireline.

Example 13b. The system according to any of Examples 1b to 12b comprising a housing, wherein: the third upper bushing is between the housing and the third piston; the housing has a channel that tapers and narrows as the housing extends towards the third upper bushing; the channel of the housing is configured to receive the wireline.

This includes, for example, a "bell housing" described elsewhere herein.

Example 14b. The system according to any of Examples 1b to 13b, wherein: each of the first, second, and third upper bushings does not include brass; each of the first, second, and third lower bushings does not include brass.

Example 15b. The system according to any of Examples 1b to 14b, wherein each of the first, second, and third resilient members includes rubber.

Example 16b. The system according to any of Examples 1b-15b, wherein at least one of the first, second, and third pistons is respectively configured to slide, independently of one another and non-simultaneously with each other, towards the first, second, and third resilient sealing members to respectively compresses the first, second, and third resilient members and consequently seal the first, second, and third resilient sealing members around the wireline when a wellbore, which is coupled to the wireline, as a pressure greater than 15,000 pounds per square inch (psi).

In other embodiments, the pressure is greater than 500 psi, 5,000 psi, 10,000 psi, 12,500 psi, 15,000 psi, or 20,000 psi.

Example 17b. The system according to any of Examples 1b to 16b comprising a first check valve including a first ball, wherein the first check valve includes a channel to receive the wireline.

Example 18b. The system of Example 17b, wherein: the first check valve includes a chamber coupled to the channel; the first check valve is configured for the ball to slide from the chamber to the channel when the wireline is removed from the channel and the wellbore has positive pressure.

Figure 2:
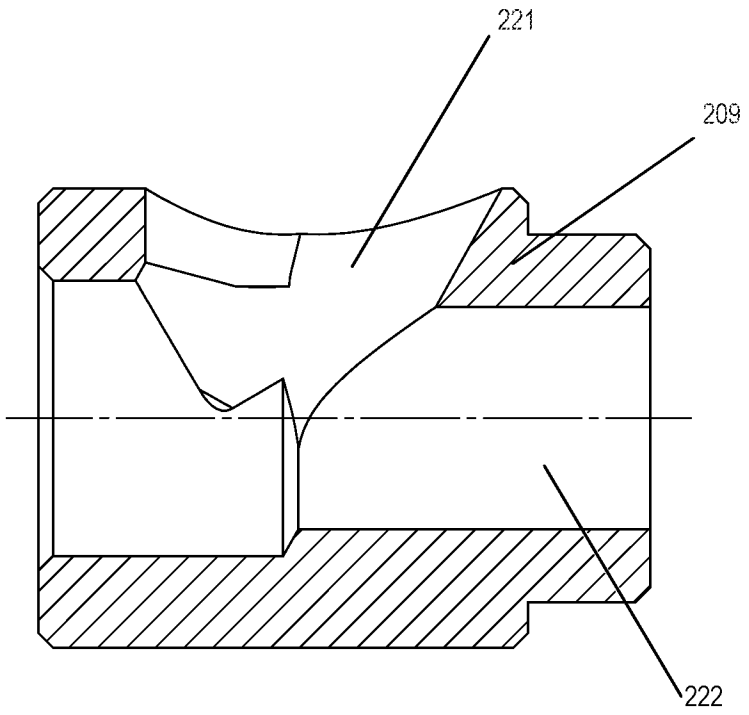
FIG. 2 includes a cross-sectional view of a ball valve body in an embodiment.
Figure 10:
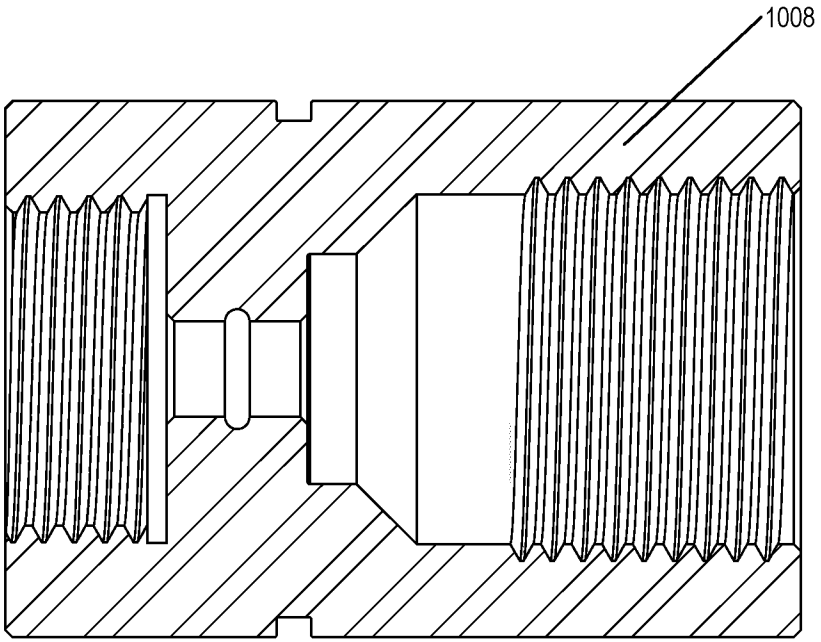
FIG. 10 includes a cross-sectional view of a ball check body in an embodiment.

For example, see FIG. 2, which discloses ball valve body 209. The ball (not shown) slides out of the way and into chamber 221 when the wireline passes into channel 222. The ball then slides out of the chamber and into the channel when the wireline is removed from the channel and pressure and fluid flow from the wellbore encourages the ball upwards away from the wellbore (where "upwards" is to the left in FIG. 2). FIG. 10 provides an embodiment of ball check body 1008, which couples to the ball valve body of FIG. 2. FIG. 12 includes a check valve insert 1207 that couples to the ball valve body of FIG. 2.

Example 19b. The system according to any of Examples 17b to 18b comprising: a second check valve including a second ball, wherein the second check valve includes a channel to receive the wireline; a third check valve including a third ball, wherein the third check valve includes a channel to receive the wireline; wherein the first resilient sealing member is between the first and second check valves and the second resilient sealing member is between the second and third check valves.

Thus, in varying embodiments check valves may be multiple or a single check valve may be used (or no check valves may be used in some embodiments). Multiple check valves provide redundancy, which adds added safety.

Example 20b. The system according to any of Examples 1b to 19b comprising: a support structure located above ground and over the wellbore, the support structure being configured to raise and lower the wireline within the wellbore; a pump coupled to the support structure; and at least one hose coupling the pump to at least one of the first, second, or third ports; wherein the pump includes fluid to pump through the at least one hose to at least one of the first, second, or third ports to respectively move at least one of the first, second, or third pistons to respectively: (a) change the first resilient member from an unsealed position to a sealed position by compressing the first resilient member with the first piston; (b) change the second resilient member from an unsealed position to a sealed position by compressing the second resilient member with the second piston; or (c) change the third resilient member from an unsealed position to a sealed position by compressing the third resilient member with the third piston.

The pump may be operated in an autonomous or semi-autonomous manner via hardwired or wireless communication channels. For example, see logic addressed in FIG. 7.

Figure 9:
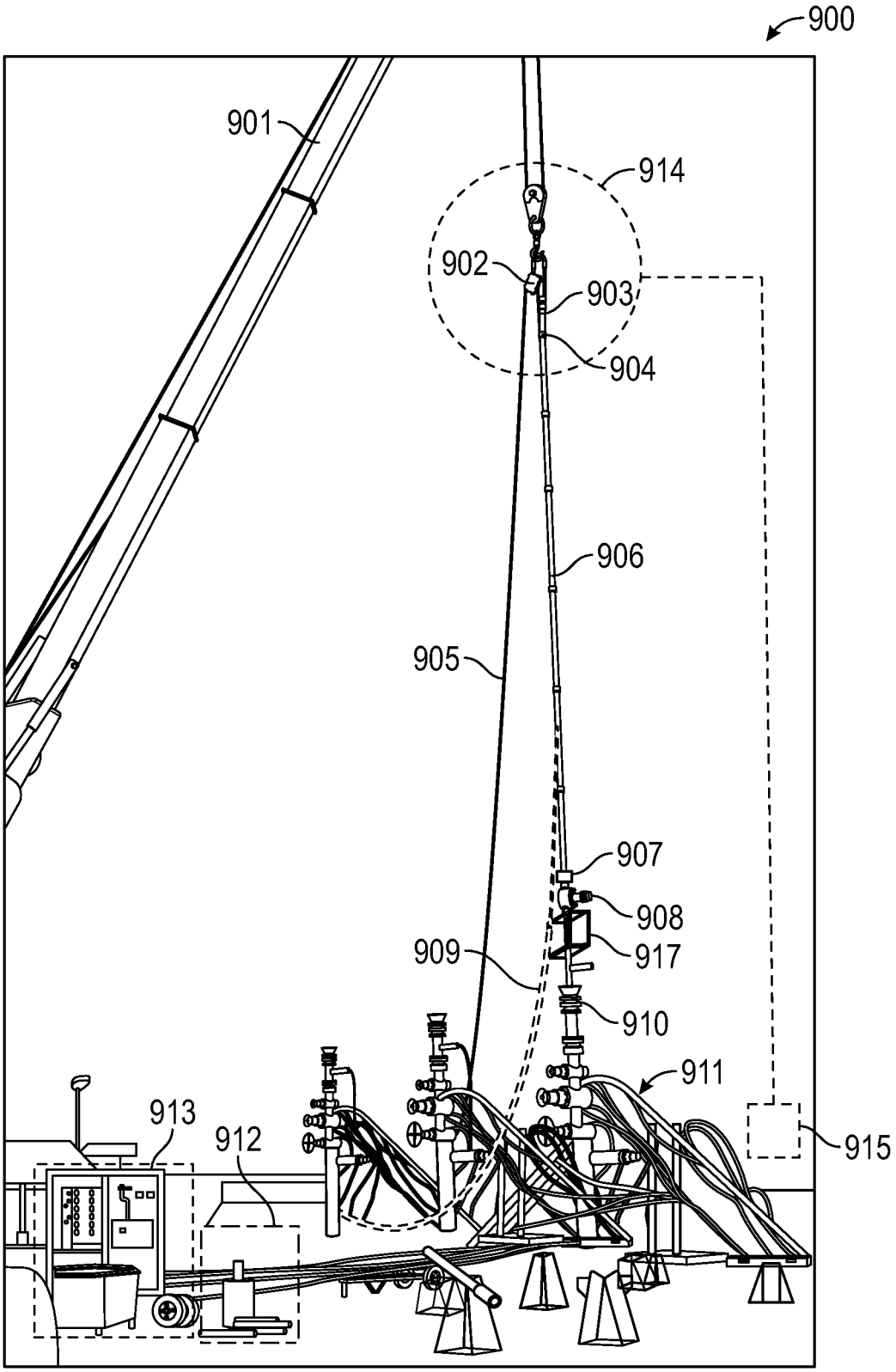
FIG. 9 includes a system, the system including an embodiment of a packoff.

FIG. 9 depicts an embodiment whereby crane 901 supports a system including sheave wheel 902, packoff 903, crossover 904, wireline cable 905, lubricator 906, tool trap 907, pump-in sub 908, rig lock 910, and wellhead 911. The system is coupled to grease unit 912 and rig lock control 913. The sheave wheel supports the wireline cable while moving tools in and out of the well. As noted above, the packoff allows the wireline to travel safely in and out of the well while containing well pressure and preventing fluids or gases from escaping into the surface. The crossover is used to connect the packoff assembly to the lubricator. The lubricator is used to insert and retrieve a tool string on a well under pressure. The tool trap is a safety device installed above the wireline valves 917 and which is designed to prevent the toolstring from falling into the well in the event of cable breaking at surface. The wireline valves form a well barrier utilized to isolate pressure to allow repair of equipment above it in the event of cable breaking or damage while inside the well. The Pump-In Sub allows for bleeding off well fluids and assists in the introduction of fluids to a well for well control purposes. The Rig Lock or quick connection system is a wellhead connection that secures tools and equipment to the wellhead through remote hydraulic actuation or mechanical connection.

Embodiments remove the needs for hoses 909 previously used to inject grease to the packoff from an accumulator. Specifically, grease injection hose 909 and grease unit 912 may be optional in some embodiments that are entirely greaseless. However, hydraulic hoses may still be needed in some embodiment to open/close pistons or actuators within packoffs. Further, use of various embodiments of a packoff described herein allow an operator to forego use of a line wiper, HGT stuffing box, flow tubes, and a check valve. Instead, the operator may utilize, for example, the packoff of FIG. 1 to provide pressure control. The pump (or pumps) of embodiments such as those of FIGS. 6, 8 may be located immediately adjacent (area 914) the packoff by statically coupling the pump (or pumps) to the packoff (or a frame coupled to the packoff), suspending the packoff from the support structure, and the like. However, in other embodiments the lines (e.g., hydraulic lines) may extend to ground level where packoff pumps are located (e.g., area 915).

Example 21b. The system of Example 20b, wherein the pump is located for than 50 feet in the air and above the earth surface that interfaces a surface opening of the well.

Example 22b. The system of Example 20b, wherein the fluid is hydraulic fluid.

Example 23b. The system according to any of Examples 1b to 22b, wherein each of the first, second, and third pistons is respectively configured to slide, simultaneously with each other or non-simultaneously with each other, towards the first, second, and third resilient sealing members to respectively compress, simultaneously or non-simultaneously, the first, second, and third resilient members and consequently, simultaneously or non-simultaneously, seal the first, second, and third resilient sealing members around the wireline.

In other words, each pressure control section can operate independently of the others. Therefore, the operator (or logic autonomous logic described elsewhere herein) can operate the system such that the first section is in a sealing position while the second and third sections are not in a sealing position. A "sealing position" would be mean the corresponding piston is slid towards its resilient sealing member and is compressing the member, regardless of whether the seal is complete and there is no leaking. The operator (or logic autonomous logic described elsewhere herein) can operate the system such that the first and third sections are in a sealing position while the second section is not in a sealing position.

Example 1c. A pressure control system for sealing a wireline comprising: a first pressure control section comprising: (a) a first upper bushing and a first lower bushing; (b) a first resilient sealing member, which is between the first upper bushing and the first lower bushing, including a first channel to receive a wireline; and (c) a first piston coupled to a first port; a second pressure control section comprising: (a) a second upper bushing and a second lower bushing; (b) a second resilient sealing member, which is between the second upper bushing and the second lower bushing, including a second channel to receive the wireline; and (c) a second piston coupled to a second port; a third pressure control section comprising: (a) a third upper bushing and a third lower bushing; (b) a third resilient sealing member, which is between the third upper bushing and the third lower bushing, including a third channel to receive the wireline; and (c) a third piston coupled to a third port; wherein each of the first, second, and third pistons is respectively configured to slide, independently of one another and non-simultaneously with one another, towards the first, second, and third resilient sealing members to respectively compress the first, second, and third resilient members and consequently seal the first, second, and third resilient sealing members around the wireline.

Another version of Example 1c. A pressure control system for sealing a wireline comprising: a first pressure control section comprising: (a) a first resilient sealing member including a first channel to receive a wireline; and (b) a first piston coupled to a first port; a second pressure control section comprising: (a) a second resilient sealing member including a second channel to receive the wireline; and (b) a second piston coupled to a second port; a third pressure control section comprising: (a) a third resilient sealing member including a third channel to receive the wireline; and (b) a third piston coupled to a third port; wherein each of the first, second, and third pistons is respectively configured to slide, independently of one another and non-simultaneously with one another, towards the first, second, and third resilient sealing members to respectively compress the first, second, and third resilient members and consequently seal the first, second, and third resilient sealing members around the wireline.

Thus, this particular embodiment does not necessarily include the bushings found in other embodiments described herein.

Example 2c. The system of example 1c, wherein: a wireline axis simultaneously extends through the first channel, the second channel, and the third channel; a first axis, which is parallel to the wireline axis, simultaneously extends through (a) the first, second, and third upper bushings, (b) the first, second, and third lower bushings, and (c) the first, second, and third resilient sealing members.

Example 3c. The system according to any of examples 1c-2c, wherein: the first port is configured to couple to a fluid source; and the first piston is configured to alternatively slide towards and away from the first resilient sealing member to alternatively seal and unseal the wireline in response to fluid from the fluid source respectively traversing the first port in a first direction and traversing the first port in a second direction that is opposite the first direction.

Example 4c. The system according to any of examples 1c-3c comprising: a first void at least partially below the first piston; a second void at least partially between first and second pistons; a third void at least partially between the second and third pistons; a first auxiliary port coupled to the first void; a second auxiliary port coupled to the second void; and a third auxiliary port coupled to the third void; wherein the first port is not fluidly coupled to the first void, the second port is not fluidly coupled to the second void, and the third port is not fluidly coupled to the third void.

Example 5c. The system of example 4c comprising at least one pressure sensor coupled to the first, second, and third auxiliary ports.

Example 6c. The system of example 5c comprising at least one non-transitory machine-readable medium having stored thereon data which, if used by at least one machine, causes the at least one machine to perform operations comprising: determine a first magnitude of a first pressure in the first void when the first resilient member is in a sealing position and is compressed by the first piston; in response to determining the first magnitude of the first pressure, configuring a pump to operate at an activity level to pressure the first void at a target pressure; comparing the activity level to a threshold activity level and determining the activity level does not exceed the threshold activity level; wherein the activity level is based on at least one of a predetermined pump volume, a predetermined pump pressure, or combinations thereof.

Another version of Example 6c. The system of example 5c comprising at least one non-transitory machine-readable medium having stored thereon data which, if used by at least one machine, causes the at least one machine to perform operations comprising: determine a first magnitude of a first pressure in the first void; in response to determining the first magnitude of the first pressure, configuring a pump to operate at an activity level to seal the first resilient member with the first piston; comparing the activity level to a threshold activity level and determining the activity level does not exceed the threshold activity level; wherein the activity level is based on at least one of a predetermined pump volume, a predetermined pump pressure, or combinations thereof.

For example, see FIG. 7, blocks 701, 702. As used herein, "determine a first magnitude of a first pressure in the first void" does not necessarily mean a direct measurement of pressure in the void but may instead be derived from such a pressure in the void.

The processes in Example 6c, or any other example, do not necessarily have to occur in any set order.

Example 7c. The system of example 6c, wherein the operations comprise: in response to determining the first magnitude of the first pressure, determine a second magnitude of a second pressure in the second void; comparing the second magnitude to a threshold; in response to comparing the second magnitude to the threshold, moving at least one of: (a) the second resilient member from an unsealed position to a sealing position by compressing the second resilient member with the second piston, or (b) the third resilient member from an unsealed position to a sealing position by compressing the third resilient member with the third piston.

For example, see FIG. 7, blocks 703, 706.

Example 8c. The system of example 6c, wherein the operations comprise: in response to determining the first magnitude of the first pressure, determine a second magnitude of a second pressure in the second void; comparing the second magnitude to a threshold; in response to comparing the second magnitude to the threshold, operating the pump at an increased activity level to pressure the first void at a target pressure.

For example, see FIG. 7, block 710.

Example 9c. The system of example 8c, wherein the operations comprise: in response to comparing the second magnitude to the threshold, determining whether the pump is operating at an additional activity level that is greater than an additional threshold activity level; in response to determining whether the pump is operating at the additional activity level that is greater than the additional threshold activity level, operating the pump at an increased activity level to pressure the first void at an additional target pressure.

For example, see FIG. 7, block 704. In an embodiment, the target pressure and additional target pressure may be equal, the activity level and additional activity level may be equal, the threshold activity level may equal the additional threshold activity level, etc.

Example 10c. The system according to any examples 4c to 9c comprising a valve coupled to the first auxiliary port, wherein: the valve has a plurality of positions; in a first of the plurality of positions the valve couples the first auxiliary port to atmosphere to vent the first void.

Example 11c. The system of example 10c, wherein in a second of the plurality of positions the valve couples the first auxiliary port to the first pressure transducer.

Example 12c. The system of example 5c comprising at least one machine-readable medium having stored thereon data which, if used by at least one machine, causes the at least one machine to perform operations comprising: determine a magnitude of a pressure in one of the first, second, or third voids; in response to determining the magnitude of the pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

The use of packoffs need not occur in any specific direction. For example, a most downstream packoff may be used until it fails and then a more upstream packoff may be used. However, a most upstream packoff may be used until it fails and then a more downstream packoff may be used Example 13c. The system of example 12c comprising at least one machine-readable medium having stored thereon data which, if used by at least one machine, causes the at least one machine to perform operations comprising: determine a magnitude of a pressure in another of the first, second, or third voids; in response to determining the magnitude of the pressure in the another of the first, second, or third voids, moving at least another of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Example 14c. The system of example 12c comprising at least one machine-readable medium having stored thereon data which, if used by at least one machine, causes the at least one machine to perform operations comprising: determine a magnitude of a pressure in another of the first, second, or third voids; in response to determining the magnitude of the pressure in the another of the first, second, or third voids, increasing compression: (a) of the first resilient member by the first piston, (b) of the second resilient member by the second piston, or (c) of the third resilient member by the third piston.

Example 15c. The system of example 5c comprising at least one machine-readable medium having stored thereon data which, if used by at least one machine, causes the at least one machine to perform operations comprising: determine a magnitude of a differential pressure present between any two of the first, second, or third voids; in response to determining the magnitude of the differential pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Another version Example 15c. The system of example 5c comprising at least one machine-readable medium having stored thereon data which, if used by at least one machine, causes the at least one machine to perform operations comprising: determine a magnitude of an absolute pressure present between any two of the first, second, or third voids; in response to determining the magnitude of the differential pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Example 16c. The system according to any of examples 1c to 15c, wherein the wireline is a greaseless wireline that includes a cable coated with a polymer.

Another version of Example 16c. The system according to any of examples 1c to 15c, wherein the wireline is a greaseless wireline that includes a cable coated with a jacket material.

Example 17c. The system according to any of examples 1c to 16c comprising a housing, wherein: the third upper bushing is between the housing and the third piston; the housing has a channel that tapers and narrows as the housing extends towards the third upper bushing; the channel of the housing is configured to receive the wireline.

Example 18c. The system according to any of examples 1c to 17c, wherein: none of the first, second, or third upper bushings includes brass; none of the first, second, or third lower bushings includes brass; and each of the first, second, and third resilient members includes rubber.

Example 19c. The system according to any of examples 1c-18c, wherein at least one of the first, second, and third pistons is respectively configured to slide, independently of one another and non-simultaneously with each other, towards the first, second, and third resilient sealing members to respectively compress the first, second, and third resilient members and consequently seal the first, second, and third resilient sealing members around the wireline when a wellbore, which is coupled to the wireline, is at a pressure greater than 15,000 pounds per square inch (psi).

Example 20c. The system according to any of examples 1c to 19c comprising a first check valve including a first ball, wherein the first check valve: includes both a channel to receive the wireline and a chamber coupled to the channel; is configured for the ball to slide from the chamber to the channel when the wireline is removed from the channel and the wellbore has positive pressure.

Example 21c. The system according to any of examples 1c to 20c comprising: a support structure located above ground and over a wellbore, the support structure being configured to raise and lower the wireline within the wellbore; a pump coupled to the support structure; and at least one hose coupling the pump to at least one of the first, second, or third ports; wherein the pump includes fluid to pump through the at least one hose to at least one of the first, second, or third ports to respectively move at least one of the first, second, or third pistons to respectively: (a) change the first resilient member from an unsealed position to a sealed position by compressing the first resilient member with the first piston; (b) change the second resilient member from an unsealed position to a sealed position by compressing the second resilient member with the second piston; or (c) change the third resilient member from an unsealed position to a sealed position by compressing the third resilient member with the third piston.

Example 22c. The system of example 21c, wherein the pump is located more than 50 feet in the air and above the earth surface that interfaces a surface opening of the wellbore.

Example 23c. The system according to any of examples 1c to 22c, wherein each of the first, second, and third pistons is respectively configured to slide, simultaneously with each other or non-simultaneously with each other, towards the first, second, and third resilient sealing members to respectively compress, simultaneously or non-simultaneously, the first, second, and third resilient members and consequently, simultaneously or non-simultaneously, seal the first, second, and third resilient sealing members around the wireline.

Example 1d. A pressure control system for sealing a wireline comprising: a first pressure control section comprising: (a) a first upper bushing and a first lower bushing; (b) a first resilient sealing member, which is between the first upper bushing and the first lower bushing, including a first channel to receive a wireline; and (c) a first piston coupled to a first port; a second pressure control section comprising: (a) a second upper bushing and a second lower bushing; (b) a second resilient sealing member, which is between the second upper bushing and the second lower bushing, including a second channel to receive the wireline; and (c) a second piston coupled to a second port; a third pressure control section comprising: (a) a third upper bushing and a third lower bushing; (b) a third resilient sealing member, which is between the third upper bushing and the third lower bushing, including a third channel to receive the wireline; and (c) a third piston coupled to a third port; wherein each of the first, second, and third pistons is respectively configured to slide, independently of one another and non-simultaneously with one another, towards the first, second, and third resilient sealing members to respectively compress the first, second, and third resilient members and consequently seal the first, second, and third resilient sealing members around the wireline.

Example 2d. The system of Example 1d, wherein: a wireline axis simultaneously extends through the first channel, the second channel, and the third channel; a first axis, which is parallel to the wireline axis, simultaneously extends through (a) the first, second, and third upper bushings, (b) the first, second, and third lower bushings, and (c) the first, second, and third resilient sealing members.

Example 3d. The system according to any of Examples 1d-2d, wherein: the first port is configured to couple to a fluid source; and the first piston is configured to alternatively slide towards and away from the first resilient sealing member to alternatively seal and unseal the wireline in response to fluid from the fluid source respectively traversing the first port in a first direction and traversing the first port in a second direction that is opposite the first direction.

Example 4d. The system according to any of Examples 1d-3d comprising: a first void at least partially below the first piston; a second void at least partially between first and second pistons; a third void at least partially between the second and third pistons; a first auxiliary port coupled to the first void; a second auxiliary port coupled to the second void; and a third auxiliary port coupled to the third void; wherein the first port is not fluidly coupled to the first void, the second port is not fluidly coupled to the second void, and the third port is not fluidly coupled to the third void.

Example 5d. The system of Example 4d comprising at least one pressure sensor coupled to the first, second, and third auxiliary ports.

Example 6d. The system of Example 5d comprising at least one non-transitory machine-readable medium having stored thereon data which, if used by at least one machine, causes the at least one machine to perform operations comprising: determine a first magnitude of a first pressure in the first void; in response to determining the first magnitude of the first pressure, determining an activity level at which to operate a pump to seal the first resilient member with the first piston; comparing the activity level to a threshold activity level and determining the activity level does not exceed the threshold activity level; wherein the activity level is based on at least one of a predetermined pump volume, a predetermined pump pressure, or combinations thereof.

Another version of Example 6d. The system of Example 5d comprising at least one non-transitory machine-readable medium having stored thereon data which, if used by at least one machine, causes the at least one machine to perform operations comprising: determine a first magnitude of a first pressure in the first void; determining an activity level at which to operate a pump to seal the first resilient member with the first piston; comparing the activity level to a threshold activity level and determining the activity level does not exceed the threshold activity level; wherein the activity level is based on at least one of a predetermined pump volume, a predetermined pump pressure, or combinations thereof.

Thus, "determining an activity level at which to operate a pump to seal the first resilient member with the first piston" does not have to be "in response to determining the first magnitude of the first pressure".

Example 7d. The system of Example 6d, wherein the operations comprise: in response to determining the first magnitude of the first pressure, determine a second magnitude of a second pressure in the second void; comparing the second magnitude to a threshold; in response to comparing the second magnitude to the threshold, moving at least one of: (a) the second resilient member from an unsealed position to a sealing position by compressing the second resilient member with the second piston, or (b) the third resilient member from an unsealed position to a sealing position by compressing the third resilient member with the third piston.

Example 8d. The system of Example 6d, wherein the operations comprise: in response to determining the first magnitude of the first pressure, determine a second magnitude of a second pressure in the second void; comparing the second magnitude to a threshold; in response to comparing the second magnitude to the threshold, operating the pump at an increased activity level to seal the first resilient member with the first piston; wherein the increased activity level is greater than the activity level.

Example 9d. The system of Example 8d, wherein the operations comprise: in response to comparing the second magnitude to the threshold, determining whether the pump is operating at an additional activity level that is greater than an additional threshold activity level; in response to determining whether the pump is operating at the additional activity level that is greater than the additional threshold activity level, operating the pump at the increased activity level to seal the first resilient member with the first piston.

In an embodiment, the additional activity level is unequal to the activity level. However, in another embodiment the levels may be equal.

Example 10d. The system according to any Examples 4d to 9d comprising a valve coupled to the first auxiliary port, wherein: the valve has a plurality of positions; in a first of the plurality of positions the valve couples the first auxiliary port to atmosphere to vent the first void.

Example 11d. The system of Example 10d, wherein in a second of the plurality of positions the valve couples the first auxiliary port to the at least one pressure transducer.

Example 12d. The system of Example 5d comprising at least one non-transitory machine-readable medium having stored thereon data which, if used by at least one machine, causes the at least one machine to perform operations comprising: determine a magnitude of a pressure in one of the first, second, or third voids; in response to determining the magnitude of the pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Example 13d. The system of Example 12d, wherein the operations comprise: determine a magnitude of a pressure in another of the first, second, or third voids; in response to determining the magnitude of the pressure in the another of the first, second, or third voids, moving at least another of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Another version of Example 13d. The system of Example 12d, wherein the operations comprise: determine a magnitude of a pressure in another of the first, second, or third voids; in response to determining the magnitude of the pressure in the another of the first, second, or third voids, moving at least another of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston; wherein the another of the first, second, or third voids is upstream of the one of the first, second, or third voids.

Example 14d. The system of Example 12d, wherein the operations comprise: determine a magnitude of a pressure in another of the first, second, or third voids; in response to determining the magnitude of the pressure in the another of the first, second, or third voids, increasing compression: (a) of the first resilient member by the first piston, (b) of the second resilient member by the second piston, or (c) of the third resilient member by the third piston.

Example 15d. The system of Example 5d comprising at least non-transitory one machine-readable medium having stored thereon data which, if used by at least one machine, causes the at least one machine to perform operations comprising: determine a magnitude of a pressure present between any two of the first, second, or third voids; in response to determining the magnitude of the differential pressure, moving at least one of: (a) the first resilient member from an unsealed position to a sealing position by compressing the first resilient member with the first piston, (b) the second resilient member from an unsealed position to a sealing position by compressing the second resilient member with the second piston, or (c) the third resilient member from an unsealed position to a sealing position by compressing the third resilient member with the third piston.

Example 16d. The system according to any of Examples 1d to 15d, wherein the wireline is a greaseless wireline that includes a cable coated with a polymer.

Example 17d. The system according to any of Examples 1d to 16d comprising a housing, wherein: the third upper bushing is between the housing and the third piston; the housing has a channel that tapers and narrows as the housing extends towards the third upper bushing; the channel of the housing is configured to receive the wireline.

Example 18d. The system according to any of Examples 1d to 17d, wherein: none of the first, second, or third upper bushings includes brass; none of the first, second, or third lower bushings includes brass; and each of the first, second, and third resilient members includes rubber.

Example 19d. The system according to any of Examples 1d-18d, wherein at least one of the first, second, and third pistons is respectively configured to slide, independently of one another and non-simultaneously with each other, towards the first, second, and third resilient sealing members to respectively compress the first, second, and third resilient members and consequently seal the first, second, and third resilient sealing members around the wireline when a wellbore, which is coupled to the wireline, is at a pressure greater than 15,000 pounds per square inch (psi).

Example 20d. The system according to any of Examples 1d to 19d comprising a first check valve including a first ball, wherein the first check valve: includes both a channel to receive the wireline and a chamber coupled to the channel; is configured for the ball to slide from the chamber to the channel when the wireline is removed from the channel and the wellbore has positive pressure.

Example 21d. The system according to any of Examples 1d to 20d comprising: a support structure located above ground and over a wellbore, the support structure being configured to raise and lower the wireline within the wellbore; a pump coupled to the support structure; and at least one hose coupling the pump to at least one of the first, second, or third ports; wherein the pump includes fluid to pump through the at least one hose to at least one of the first, second, or third ports to respectively move at least one of the first, second, or third pistons to respectively: (a) change the first resilient member from an unsealed position to a sealed position by compressing the first resilient member with the first piston; (b) change the second resilient member from an unsealed position to a sealed position by compressing the second resilient member with the second piston; or (c) change the third resilient member from an unsealed position to a sealed position by compressing the third resilient member with the third piston.

Example 22d. The system of Example 21d, wherein the pump is suspended in the air and above the earth surface that interfaces a surface opening of the wellbore.

Example 23d. The system according to any of Examples 1d to 22d, wherein each of the first, second, and third pistons is respectively configured to slide, simultaneously with each other or non-simultaneously with each other, towards the first, second, and third resilient sealing members to respectively compress, simultaneously or non-simultaneously, the first, second, and third resilient members and consequently, simultaneously or non-simultaneously, seal the first, second, and third resilient sealing members around the wireline.

Figure 3:
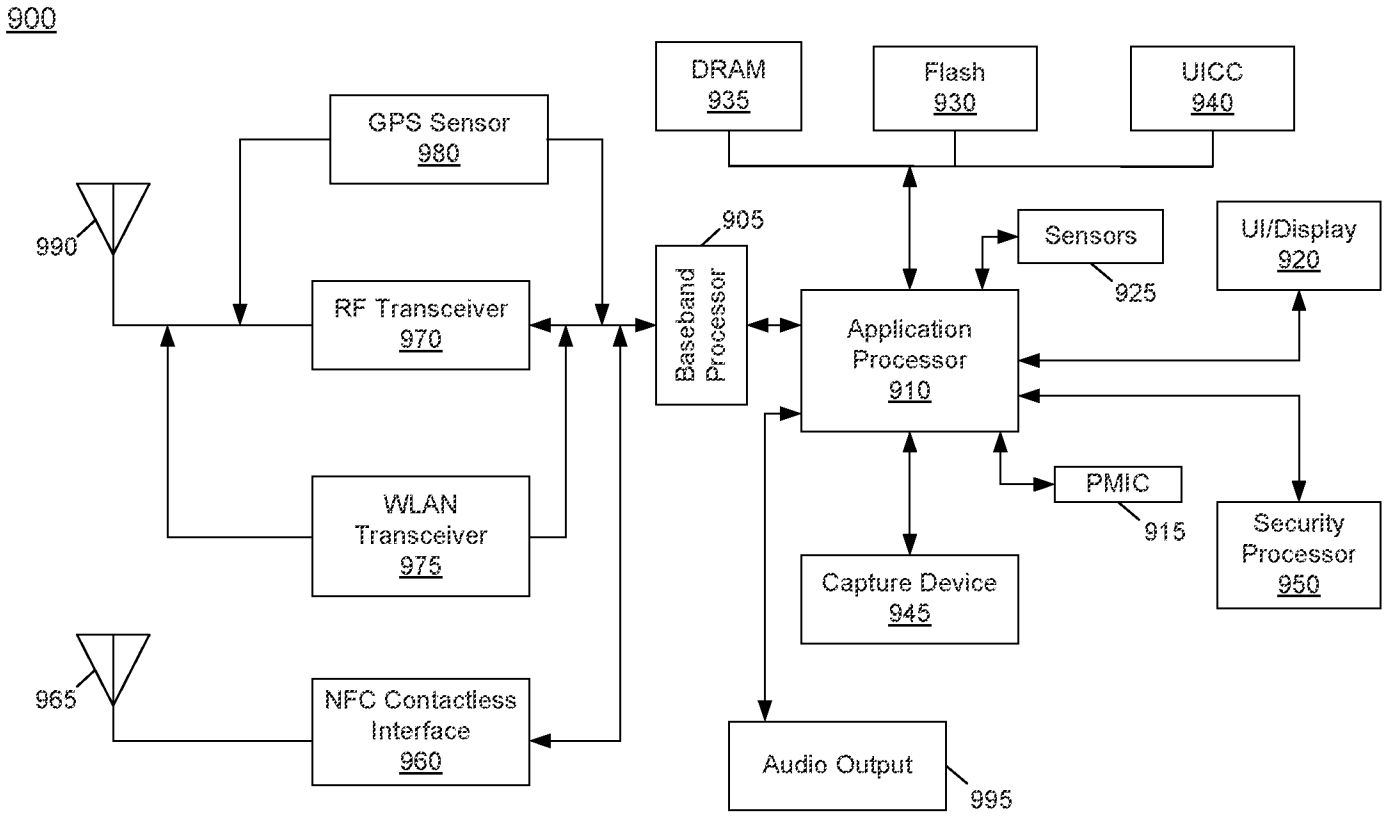
FIGS. 3, 4, 5 includes processor-based system for implementing embodiments.

FIG. 3 includes a block diagram of an example system with which embodiments can be used. As seen, system 900 may be a smartphone or other wireless communicator or any other Internet of Things (IoT) device. A baseband processor 905 is configured to perform various signal processing with regard to communication signals to be transmitted from or received by the system. In turn, baseband processor 905 is coupled to an application processor 910, which may be a main CPU of the system to execute an OS and other system software, in addition to user applications such as many well-known social media and multimedia apps. Application processor 910 may further be configured to perform a variety of other computing operations for the device.

In turn, application processor 910 can couple to a user interface/display 920 (e.g., touch screen display). In addition, application processor 910 may couple to a memory system including a non-volatile memory, namely a flash memory 930 and a system memory, namely a DRAM 935. As further seen, application processor 910 also couples to a capture device 945 such as one or more image capture devices that can record video and/or still images.

A universal integrated circuit card (UICC) 940 comprises a subscriber identity module, which in some embodiments includes a secure storage to store secure user information. System 900 may further include a security processor 950 (e.g., Trusted Platform Module (TPM)) that may couple to application processor 910. A plurality of sensors 925, including one or more multi-axis accelerometers may couple to application processor 910 to enable input of a variety of sensed information such as motion and other environmental information. In addition, one or more authentication devices may be used to receive, for example, user biometric input for use in authentication operations.

As further illustrated, a near field communication (NFC) contactless interface 960 is provided that communicates in an NFC near field via an NFC antenna 965. While separate antennae are shown, understand that in some implementations one antenna or a different set of antennae may be provided to enable various wireless functionalities.

A power management integrated circuit (PMIC) 915 couples to application processor 910 to perform platform level power management. To this end, PMIC 915 may issue power management requests to application processor 910 to enter certain low power states as desired. Furthermore, based on platform constraints, PMIC 915 may also control the power level of other components of system 900.

To enable communications to be transmitted and received such as in one or more internet of things (IoT) networks, various circuits may be coupled between baseband processor 905 and antenna 990. Specifically, a radio frequency (RF) transceiver 970 and a wireless local area network (WLAN) transceiver 975 may be present. In general, RF transceiver 970 may be used to receive and transmit wireless data and calls according to a given wireless communication protocol such as 5G wireless communication protocol such as in accordance with a code division multiple access (CDMA), global system for mobile communication (GSM), long term evolution (LTE) or other protocol. In addition, a GPS sensor 980 may be present, with location information being provided to security processor 950. Other wireless communications such as receipt or transmission of radio signals (e.g., AM/FM) and other signals may also be provided. In addition, via WLAN transceiver 975, local wireless communications, such as according to a Bluetooth™ or IEEE 802.11 standard can also be realized.

Figure 4:
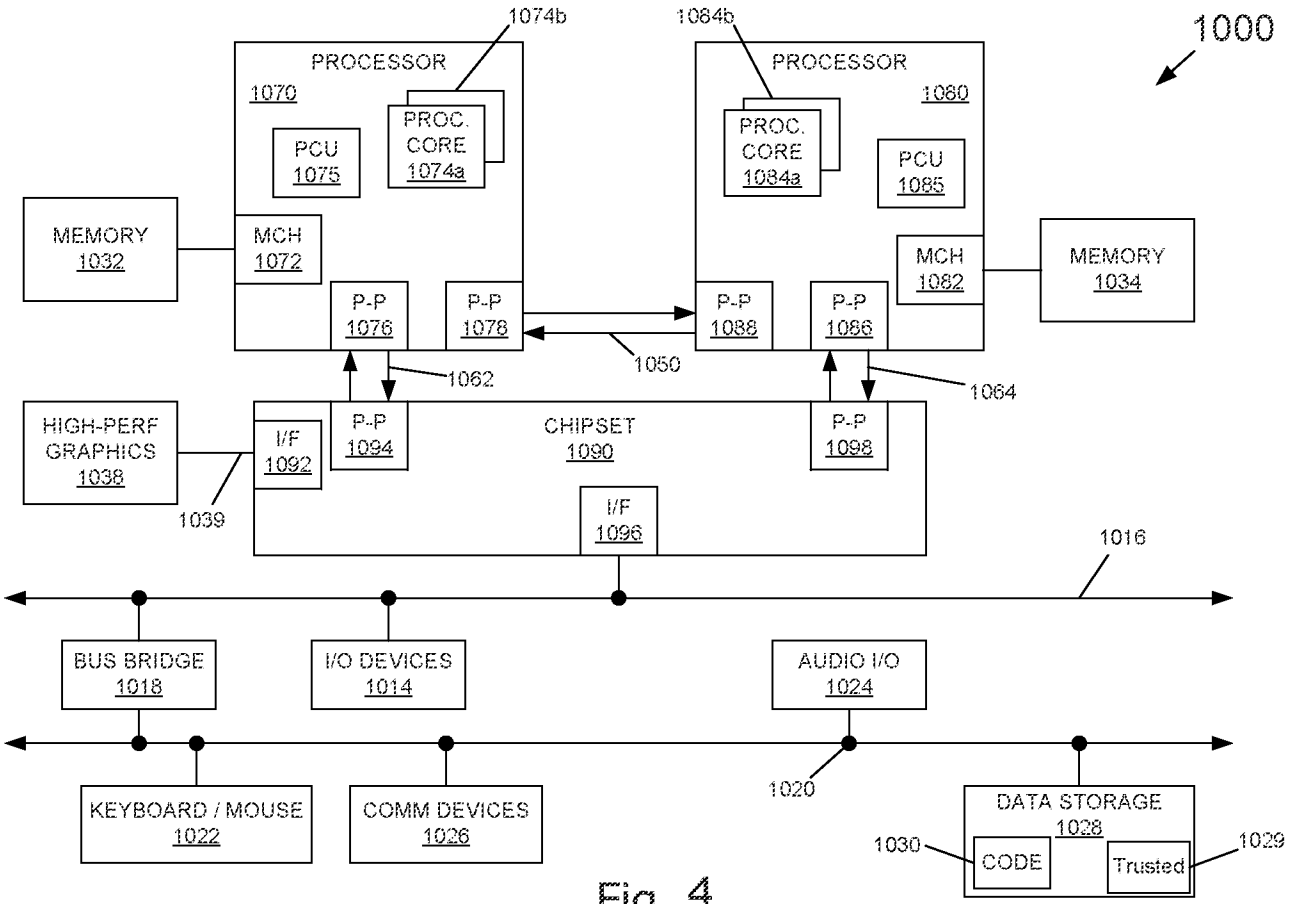

FIG. 4 shows a block diagram of a system in accordance with another embodiment of the present invention. Multiprocessor system 1000 is a point-to-point interconnect system such as a server system, and includes a first processor 1070 and a second processor 1080 coupled via a point-to-point interconnect 1050. Each of processors 1070 and 1080 may be multicore processors such as SoCs, including first and second processor cores (i.e., processor cores 1074*a* and 1074*b* and processor cores 1084*a* and 1084*b*), although potentially many more cores may be present in the processors. In addition, processors 1070 and 1080 each may include power controller unit 1075 and 1085. In addition, processors 1070 and 1080 each may include a secure engine to perform security operations such as attestations, IoT network onboarding or so forth.

First processor 1070 further includes a memory controller hub (MCH) 1072 and point-to-point (P-P) interfaces 1076 and 1078. Similarly, second processor 1080 includes a MCH 1082 and P-P interfaces 1086 and 1088. MCH's 1072 and 1082 couple the processors to respective memories, namely a memory 1032 and a memory 1034, which may be portions of main memory (e.g., a DRAM) locally attached to the respective processors. First processor 1070 and second processor 1080 may be coupled to a chipset 1090 via P-P interconnects 1062 and 1064, respectively. Chipset 1090 includes P-P interfaces 1094 and 1098.

Furthermore, chipset 1090 includes an interface 1092 to couple chipset 1090 with a high-performance graphics engine 1038, by a P-P interconnect 1039. In turn, chipset 1090 may be coupled to a first bus 1016 via an interface 1096. Various input/output (I/O) devices 1014 may be coupled to first bus 1016, along with a bus bridge 1018 which couples first bus 1016 to a second bus 1020. Various devices may be coupled to second bus 1020 including, for example, a keyboard/mouse 1022, communication devices 1026 and a data storage unit 1028 such as a non-volatile storage or other mass storage device. As seen, data storage unit 1028 may include code 1030, in one embodiment. As further seen, data storage unit 1028 also includes a trusted storage 1029 to store sensitive information to be protected. Further, an audio I/O 1024 may be coupled to second bus 1020.

Figure 5:
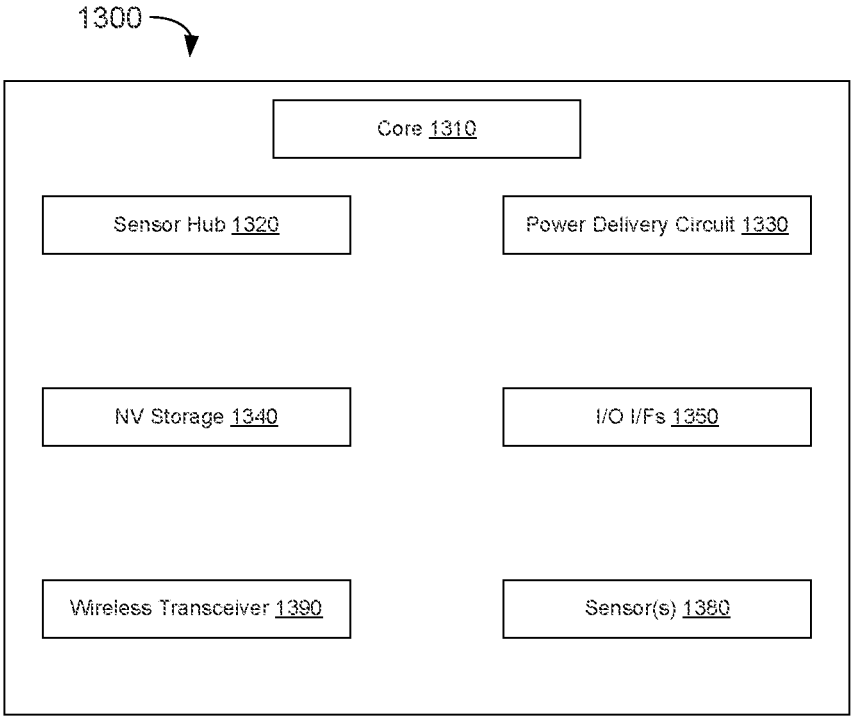

FIG. 5 depicts an IoT environment that may include wearable devices or other small form factor IoT devices. In one particular implementation, wearable module 1300 may be an Intel® Curie™ module that includes multiple components adapted within a single small module that can be implemented as all or part of a wearable device. As seen, module 1300 includes a core 1310 (of course in other embodiments more than one core may be present). Such a core may be a relatively low complexity in-order core, such as based on an Intel Architecture® Quark™ design. In some embodiments, core 1310 may implement a Trusted Execution Environment (TEE). Core 1310 couples to various components including a sensor hub 1320, which may be configured to interact with a plurality of sensors 1380, such as one or more biometric, motion, environmental or other sensors. A power delivery circuit 1330 is present, along with a non-volatile storage 1340. In an embodiment, this circuit may include a rechargeable battery and a recharging circuit, which may in one embodiment receive charging power wirelessly. One or more input/output (TO) interfaces 1350, such as one or more interfaces compatible with one or more of USB/SPI/I2C/GPIO protocols, may be present. In addition, a wireless transceiver 1390, which may be a Bluetooth™ low energy or other short-range wireless transceiver is present to enable wireless communications as described herein. In different implementations a wearable module can take many other forms. Wearable and/or IoT devices have, in comparison with a typical general-purpose CPU or a GPU, a small form factor, low power requirements, limited instruction sets, relatively slow computation throughput, or any of the above.

Embodiments may be used in many different types of systems. For example, in one embodiment a communication device can be arranged to perform the various methods and techniques described herein. Of course, the scope of the present invention is not limited to a communication device, and instead other embodiments can be directed to other types of apparatus for processing instructions, or one or more machine readable media including instructions that in response to being executed on a computing device, cause the device to carry out one or more of the methods and techniques described herein.

Program instructions may be used to cause a general-purpose or special-purpose processing system that is programmed with the instructions to perform the operations described herein. Alternatively, the operations may be performed by specific hardware components that contain hard-wired logic for performing the operations, or by any combination of programmed computer components and custom hardware components. The methods described herein may be provided as (a) a computer program product that may include one or more machine readable media having stored thereon instructions that may be used to program a processing system or other electronic device to perform the methods or (b) at least one storage medium having instructions stored thereon for causing a system to perform the methods. The term "machine readable medium" or "storage medium" used herein shall include any medium that is capable of storing or encoding a sequence of instructions (transitory media, including signals, or non-transitory media) for execution by the machine and that cause the machine to perform any one of the methods described herein. The term "machine readable medium" or "storage medium" shall accordingly include, but not be limited to, memories such as solid-state memories, optical and magnetic disks, read-only memory (ROM), programmable ROM (PROM), erasable PROM (EPROM), electrically EPROM (EEPROM), a disk drive, a floppy disk, a compact disk ROM (CD-ROM), a digital versatile disk (DVD), flash memory, a magneto-optical disk, as well as more exotic mediums such as machine-accessible biological state preserving or signal preserving storage. A medium may include any mechanism for storing, transmitting, or receiving information in a form readable by a machine, and the medium may include a medium through which the program code may pass, such as antennas, optical fibers, communications interfaces, and the like. Program code may be transmitted in the form of packets, serial data, parallel data, and the like, and may be used in a compressed or encrypted format. Furthermore, it is common in the art to speak of software, in one form or another (e.g., program, procedure, process, application, module, logic, and so on) as taking an action or causing a result. Such expressions are merely a shorthand way of stating that the execution of the software by a processing system causes the processor to perform an action or produce a result.

A module as used herein refers to any hardware, software, firmware, or a combination thereof. Often module boundaries that are illustrated as separate commonly vary and potentially overlap. For example, a first and a second module may share hardware, software, firmware, or a combination thereof, while potentially retaining some independent hardware, software, or firmware. In one embodiment, use of the term logic includes hardware, such as transistors, registers, or other hardware, such as programmable logic devices. However, in another embodiment, logic also includes software or code integrated with hardware, such as firmware or micro-code.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A pressure control system to seal a wireline comprising:

a first section comprising: (a) a first upper bushing and a first lower bushing; (b) a first resilient member, which is between the first upper bushing and the first lower bushing, including a first channel to receive a wireline; and (c) a first piston coupled to a first port;

a second section comprising: (a) a second upper bushing and a second lower bushing; (b) a second resilient member, which is between the second upper bushing and the second lower bushing, including a second channel to receive the wireline; and (c) a second piston coupled to a second port;

a third section comprising: (a) a third upper bushing and a third lower bushing; (b) a third resilient member, which is between the third upper bushing and the third lower bushing, including a third channel to receive the wireline; and (c) a third piston coupled to a third port; and wherein the first port is coupled to a first void, the second port is coupled to a second void, and the third port is coupled to a third void;

at least one non-transitory computer readable medium comprising instructions to cause at least one processor to execute a method comprising: (1) determining a first magnitude of a first pressure in the first void; (2) in response to determining the first magnitude of the first pressure, determining an activity level at which to operate a pump to seal the first resilient member with the first piston; (3) comparing the activity level to a threshold activity level and determining the activity level does not exceed the threshold activity level;

wherein the activity level is based on at least one of a predetermined pump volume, a predetermined pump pressure, or combinations thereof;

wherein each of the first, second, and third pistons is respectively arranged to slide, independently of one another and non-simultaneously with one another, towards the first, second, and third resilient members to respectively compress the first, second, and third resilient members.

2. The system of claim 1, wherein:

a wireline axis simultaneously extends through the first channel, the second channel, and the third channel;

a first axis, which is parallel to the wireline axis, simultaneously extends through (a) the first, second, and third upper bushings, (b) the first, second, and third lower bushings, and (c) the first, second, and third resilient members.

3. The system of claim 1, wherein:

the first port is arranged to couple to a fluid source; and the first piston is arranged to slide towards and away from the first resilient member to seal and unseal the wireline in response to fluid from the fluid source respectively traversing the first port in a first direction and traversing the first port in a second direction that is opposite the first direction.

4. The system of claim 1 comprising at least one pressure sensor coupled to the first, second, and third ports.

5. The system of claim 4, wherein the method comprises:

determine a magnitude of a pressure in one of the first, second, or third voids;

in response to determining the magnitude of the pressure, moving at least one of: (a) the first resilient member from an unsealed position to a sealed position by compressing the first resilient member with the first piston, (b) the second resilient member from an unsealed position to a sealed position by compressing the second resilient member with the second piston, or (c) the third resilient member from an unsealed position to a sealed position by compressing the third resilient member with the third piston.

6. The system of claim 1, wherein the method comprises:

in response to determining the first magnitude of the first pressure, determining a second magnitude of a second pressure in the second void;

comparing the second magnitude to a threshold;

in response to comparing the second magnitude to the threshold, moving at least one of:

(a) the second resilient member from an unsealed position to a sealed position by compressing the second resilient member with the second piston, or (b) the third resilient member from an unsealed position to a sealed position by compressing the third resilient member with the third piston.

7. The system of claim 1, wherein the method comprises:

in response to determining the first magnitude of the first pressure, determining a second magnitude of a second pressure in the second void;

comparing the second magnitude to a threshold;

in response to comparing the second magnitude to the threshold, operating the pump at an increased activity level to seal the first resilient member with the first piston;

wherein the increased activity level is greater than the activity level.

8. The system of claim 7, wherein the method comprises:

in response to comparing the second magnitude to the threshold, determining whether the pump is operating at an additional activity level that is greater than an additional threshold activity level;

in response to determining whether the pump is operating at the additional activity level that is greater than the additional threshold activity level, operating the pump at the increased activity level to seal the first resilient member with the first piston.

9. A pressure control system to seal a wireline comprising:

a first section comprising: (a) a first upper bushing and a first lower bushing; (b) a first resilient member, which is between the first upper bushing and the first lower bushing, including a first channel to receive a wireline; and (c) a first piston coupled to a first port;

a second section comprising: (a) a second upper bushing and a second lower bushing; (b) a second resilient member, which is between the second upper bushing and the second lower bushing, including a second channel to receive the wireline; and (c) a second piston coupled to a second port;

a third section comprising: (a) a third upper bushing and a third lower bushing; (b) a third resilient member, which is between the third upper bushing and the third lower bushing, including a third channel to receive the wireline; and (c) a third piston coupled to a third port; and wherein the first port is coupled is to a first void, the second port is coupled to a second void, and the third port is coupled to a third void;

at least one non-transitory computer readable medium comprising instructions to cause at least one processor to execute a method comprising: (1) determine a magnitude of a pressure in one of the first, second, or third voids;

and (2) in response to determining the magnitude of the pressure, moving at least one of: (2)(a) the first resilient member from an unsealed position to a sealed position by compressing the first resilient member with the first piston, (2)(b) the second resilient member from an unsealed position to a sealed position by compressing the second resilient member with the second piston, or (2)(c) the third resilient member from an unsealed position to a sealed position by compressing the third resilient member with the third piston;

wherein each of the first, second, and third pistons is respectively arranged to slide, independently of one another and non-simultaneously with one another, towards the first, second, and third resilient members to respectively compress the first, second, and third resilient members.

10. The system of claim 9, wherein:

a wireline axis simultaneously extends through the first channel, the second channel, and the third channel;

a first axis, which is parallel to the wireline axis, simultaneously extends through (a) the first, second, and third upper bushings, (b) the first, second, and third lower bushings, and (c) the first, second, and third resilient members.

11. The system of claim 9, wherein:

the first port is arranged to couple to a fluid source; and the first piston is arranged to slide towards and away from the first resilient member to seal and unseal the wireline in response to fluid from the fluid source respectively traversing the first port in a first direction and traversing the first port in a second direction that is opposite the first direction.

12. The system of claim 9 comprising at least one pressure sensor coupled to the first, second, and third ports.

13. The system of claim 12 wherein the method comprises:

determining a first magnitude of a first pressure in the first void;

in response to determining the first magnitude of the first pressure, determining an activity level at which to operate a pump to seal the first resilient member with the first piston;

comparing the activity level to a threshold activity level and determining the activity level does not exceed the threshold activity level;

wherein the activity level is based on at least one of a predetermined pump volume, a predetermined pump pressure, or combinations thereof.

14. The system of claim 13, wherein the method comprises:

in response to determining the first magnitude of the first pressure, determining a second magnitude of a second pressure in the second void;

comparing the second magnitude to a threshold;

in response to comparing the second magnitude to the threshold, moving at least one of: (a) the second resilient member from the unsealed position to the sealed position by compressing the second resilient member with the second piston, or (b) the third resilient member from the unsealed position to the sealed position by compressing the third resilient member with the third piston.

15. The system of claim 13, wherein the method comprises:

in response to determining the first magnitude of the first pressure, determining a second magnitude of a second pressure in the second void;

comparing the second magnitude to a threshold;

in response to comparing the second magnitude to the threshold, operating the pump at an increased activity level to seal the first resilient member with the first piston;

wherein the increased activity level is greater than the activity level.

16. The system of claim 15, wherein the method comprises:

in response to comparing the second magnitude to the threshold, determining whether the pump is operating at an additional activity level that is greater than an additional threshold activity level;

in response to determining whether the pump is operating at the additional activity level that is greater than the additional threshold activity level, operating the pump at the increased activity level to seal the first resilient member with the first piston.

* * * * *